US009886900B2

(12) United States Patent
Hwang et al.

(10) Patent No.: US 9,886,900 B2
(45) Date of Patent: Feb. 6, 2018

(54) ORGANIC LIGHT EMITTING DISPLAY DEVICE AND DRIVING METHOD THEREOF

(71) Applicant: SAMSUNG DISPLAY CO., LTD., Yongin, Gyeonggi-Do (KR)

(72) Inventors: Young-In Hwang, Yongin (KR); Ji-Hye Kong, Yongin (KR); Yong-Sung Park, Yongin (KR); In-Ho Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 231 days.

(21) Appl. No.: 14/806,333

(22) Filed: Jul. 22, 2015

(65) Prior Publication Data

US 2016/0125774 A1 May 5, 2016

(30) Foreign Application Priority Data

Nov. 5, 2014 (KR) ..... 10-2014-0153033

(51) Int. Cl.

*G09G 3/3233* (2016.01)
*G09G 3/00* (2006.01)
*G09G 3/3225* (2016.01)

(52) U.S. Cl.

CPC ..... *G09G 3/3233* (2013.01); *G09G 3/003* (2013.01); *G09G 3/3225* (2013.01); *G09G 2300/0814* (2013.01); *G09G 2300/0819* (2013.01); *G09G 2300/0852* (2013.01); *G09G 2300/0861* (2013.01); *G09G 2310/0262* (2013.01); *G09G 2310/08* (2013.01); *G09G 2320/045* (2013.01)

(58) Field of Classification Search

CPC ..... G09G 3/3208–3/3291; G09G 2310/0202
See application file for complete search history.

(56) References Cited

U.S. PATENT DOCUMENTS

| | | | | |
|---|---|---|---|---|
| 8,947,331 | B2 * | 2/2015 | Hwang | G09G 3/003 315/169.3 |
| 9,159,265 | B2 * | 10/2015 | Han | G09G 3/3233 |
| 9,245,480 | B2 * | 1/2016 | Kim | G09G 3/3233 |
| 9,514,678 | B2 * | 12/2016 | Park | G09G 3/3233 |
| 2005/0017934 | A1 * | 1/2005 | Chung | G09G 3/3233 345/82 |
| 2006/0267885 | A1 * | 11/2006 | Kwak | G09G 3/3233 345/76 |
| 2008/0211397 | A1 * | 9/2008 | Choi | G09G 3/3233 313/504 |
| 2011/0025671 | A1 | 2/2011 | Lee | |

(Continued)

FOREIGN PATENT DOCUMENTS

| | | | |
|---|---|---|---|
| KR | 10-2005-0005646 | A | 1/2005 |
| KR | 10-2011-0136775 | A | 12/2011 |

(Continued)

*Primary Examiner* — Patrick F Marinelli
(74) *Attorney, Agent, or Firm* — Lewis Roca Rothgerber Christie LLP

(57) ABSTRACT

An organic light emitting display device includes pixels. Each of the pixels includes an organic light emitting diode. The organic light emitting diode does not emit light during a first period where a voltage having a first level voltage is applied to the first voltage supply line, and the organic light emitting diode emits light during a second period where a second level voltage is applied to the first voltage supply line.

18 Claims, 8 Drawing Sheets

(56) References Cited

U.S. PATENT DOCUMENTS

| | | | | |
|---|---|---|---|---|
| 2012/0001893 | A1 | 1/2012 | Jeong et al. | |
| 2012/0113234 | A1 | 5/2012 | Hwang | |
| 2012/0139901 | A1* | 6/2012 | Hwang | H04N 13/0497 345/419 |
| 2012/0146999 | A1* | 6/2012 | Hwang | G09G 3/003 345/419 |
| 2013/0249883 | A1* | 9/2013 | Hwang | G09G 3/003 345/212 |
| 2014/0191669 | A1* | 7/2014 | Tan | G09G 3/3233 315/172 |
| 2014/0354518 | A1* | 12/2014 | Park | G09G 3/3233 345/76 |
| 2016/0125774 | A1* | 5/2016 | Hwang | G09G 3/003 345/215 |
| 2016/0247453 | A1* | 8/2016 | Hwang | G09G 3/003 |

FOREIGN PATENT DOCUMENTS

| | | | |
|---|---|---|---|
| KR | 10-2012-0002070 | A | 1/2012 |
| KR | 10-2012-0048281 | A | 5/2012 |
| KR | 10-2012-0065139 | A | 6/2012 |

* cited by examiner

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2014-0153033, filed on Nov. 5, 2014, in the Korean Intellectual Property Office, the entire contents of which are incorporated herein by reference in their entirety.

BACKGROUND

1. Field

Various embodiments of the present disclosure relate to an organic light emitting display device that is capable of displaying a three-dimensional image, and a driving method thereof.

2. Description of Related Art

Various display devices having reduced weight and volume in comparison to cathode ray tube have been developed. Various types of display devices include liquid crystal displays, field emission displays, plasma display panels, and organic light emitting display devices.

As demand for three-dimensional images increases, a method of using shutter glasses has been developed. A display device repeats a step of stopping displaying, a step of displaying a left eye image, a step of stopping displaying, and a step of displaying a right eye image. The left eye is displayed on the user's left eye, and the right eye image is displayed on the user's right eye, and thus the user may have a sense of distance. This way, the shutter glasses are synchronized with a display device, such that when a left eye image is being displayed, a portion that corresponds to a left eye is controlled to transmit light, and when a right eye image is being displayed, a portion that corresponds to a right eye is controlled to transmit light.

SUMMARY

According to an embodiment of the present disclosure, there is provided an organic light emitting display device including: pixels, each including an organic light emitting diode having an anode electrode and a cathode electrode, and a pixel driving circuit configured to output a driving current to the organic light emitting diode; scan lines and data lines electrically connected to the pixels; and a first voltage supply line and a second voltage supply line electrically connected to the pixels, wherein the pixel driving circuit includes a driving transistor configured to control a level of each driving current, and the cathode electrode is electrically connected to the first voltage supply line, the organic light emitting diode is configured to not emit light during a first period where a first level voltage is applied to the first voltage supply line, and to emit light during a second period where a second level voltage is applied to the first voltage supply line, a voltage stored in the pixels affects a voltage applied to a gate electrode of the driving transistor during at least a portion of the first period, and a third level voltage is applied to the second voltage supply line during the second period, and the third level voltage is stored in at least some of the pixels during at least a portion of the second period.

The organic light emitting display device may further include a third voltage supply line electrically connected to the pixels, the pixel driving circuit further including a first transistor, a second transistor, a third transistor, a fourth transistor, a fifth transistor, a first capacitor, and a second capacitor, the gate electrode of the driving transistor may be connected to a first node, a first electrode of the driving transistor may be connected to a second node, and a second electrode of the driving transistor may be connected to a third node, a first electrode of the first transistor may be connected to the first node, and a second electrode of the first transistor may be connected to the third node, a first electrode of the second transistor may be connected to a fourth node, and a second electrode of the second transistor may be connected to the second node, a first electrode of the third transistor may be connected to the second voltage supply line, and a second electrode of the third transistor may be connected to the second node, a first electrode of the fourth transistor may be connected to the third node, and the second electrode of the fourth transistor may be connected to the anode electrode, a gate electrode of the fifth transistor may be connected to one of the scan lines, a first electrode of the fifth transistor may be connected to one of the data lines, and a second electrode of the fifth transistor may be connected to the fourth node, one end of the first capacitor may be connected to the second voltage supply line, and another end of the first capacitor may be connected to the first node, and one end of the second capacitor may be connected to the third voltage supply line, and another end of the second capacitor may be connected to a fourth node.

The a first control signal may be applied to a gate electrode of the first transistor, a second control signal may be applied to a gate electrode of the second transistor, a third control signal may be applied to a gate electrode of the third transistor, and a fourth control signal may be applied to a gate electrode of the fourth transistor.

The organic light emitting display device may further include a sixth transistor connected between the fourth node and the second capacitor, and wherein a first control signal may be applied to a gate electrode of the first transistor and a gate electrode of the second transistor, a second control signal may be applied to a gate electrode of the third transistor, a third control signal may be applied to a gate electrode of the fourth transistor, and a fourth control signal may be applied to a gate electrode of the sixth transistor.

The organic light emitting display device may further include a seventh transistor connected between the first node and the anode electrode, and wherein a first control signal may be applied to a gate electrode of the first transistor and a gate electrode of the second transistor, a second control signal may be applied to a gate electrode of the third transistor and a gate electrode of the fourth transistor, and a third control signal may be applied to a gate electrode of the seventh transistor.

During the first period, the driving transistor may be turned off in response to a fourth level voltage being applied to the second voltage supply line, the first transistor, the third transistor, and the fourth transistor being turned on, and the second transistor being turned off, and during the first period, a voltage level of the anode electrode may be initialized in response to the fourth level voltage being applied to the second voltage supply line, the third transistor and fourth transistor being turned on, and the first transistor and second transistor being turned off.

During the first period, the driving transistor may be turned off in response to a fourth level voltage being applied to the second voltage supply line, the third transistor, the fourth transistor, and the seventh transistor being turned on, and the first transistor and the second transistor being turned off, and during the first period, a voltage level of the anode electrode may be initialized in response to the fourth level voltage being applied to the second voltage supply line, the third transistor and the fourth transistor being turned on, and the first transistor, the second transistor, and the seventh transistor being turned off.

During the first period, a threshold voltage of the driving transistor may be compensated in response to a fifth level voltage being applied to the second voltage supply line, the first transistor, the third transistor, and the fourth transistor being turned on, and the second transistor being turned off.

During the first period, a threshold voltage of the driving transistor may be compensated in response to a reference level voltage being applied to the data lines, the first transistor, the second transistor, the fourth transistor and the fifth transistor being turned on, and the third transistor and the sixth transistor being turned off.

During the first period, a threshold voltage of the driving transistor may be compensated in response to a fifth level voltage being applied to the second voltage supply line, the third transistor, the fourth transistor, and the seventh transistor being turned on, and the first transistor and second transistor being turned off.

The voltage stored in the pixels may include the voltage being stored in the fourth node, and in response to the second transistor being turned on, the voltage stored in the fourth node may affect a voltage being applied to the first node.

The voltage stored in the pixels may include the voltage being stored in the fifth node, and in response to the second transistor and the sixth transistor being turned on, the voltage stored in the fifth node may affect a voltage being applied to the first node.

The third level voltage may correspond to the first level voltage, and the fourth level voltage may correspond to the second level voltage.

The fifth level voltage may be between the third level voltage and the fourth level voltage, and may be lower than a minimum level of the voltage applied to the data lines.

According to another embodiment of the present disclosure, there is provided a method for driving an organic light emitting display device including pixels, each including an organic light emitting diode having an anode electrode and a cathode electrode, and a pixel driving circuit configured to output a driving current to the organic light emitting diode; scan lines and data lines electrically connected to the pixels; a first voltage supply line connected to the cathode electrode and a second voltage supply line electrically connected to a gate electrode of a driving transistor through a first capacitor, the method including: stopping the organic light emitting diode from emitting light; turning off the driving transistor in the pixel driving circuit; initializing a voltage level of the anode electrode; compensating a threshold voltage of the driving transistor; and emitting light with the organic light emitting diode, wherein at the stopping the organic light emitting diode from emitting light, a voltage level applied to the first voltage supply line changes to a first level, and at the emitting light with the organic light emitting diode, a voltage level being applied to the first voltage supply line changes to a second level, a voltage having a third level may be applied to the second voltage supply line, and a voltage may be stored in at least some of the pixels.

At the turning off the driving transistor in the pixel driving circuit, the gate electrode of the driving transistor may be electrically connected to a second electrode of the driving transistor, a first electrode of the driving transistor may be electrically connected to the second voltage supply line, the second electrode of the driving transistor may be electrically connected to the anode electrode, and a third level voltage may be applied to the second voltage supply line, and at the initializing a voltage level of the anode electrode, the gate electrode of the driving transistor may be electrically disconnected from the second electrode of the driving transistor, the first electrode of the driving transistor may be electrically connected to the second voltage supply line, the second electrode of the driving transistor may be electrically connected to the anode electrode, and a fourth level voltage may be applied to the second voltage supply line.

At the compensating a threshold voltage of the driving transistor, the gate electrode of the driving transistor may be electrically connected to the second electrode of the driving transistor, the first electrode of the driving transistor may be electrically connected to the second voltage supply line, the second electrode of the driving transistor may be electrically connected to the anode electrode, and a fifth level voltage may be applied to the second voltage supply line.

The fifth voltage level may be between the third voltage level and the fourth voltage level, and may be lower than a minimum level that at which a voltage is to be applied to the data lines.

At the compensating a threshold voltage of the driving transistor, the gate electrode of the driving transistor may be electrically connected to the second electrode of the driving transistor, the first electrode of the driving transistor may be electrically connected to one of the data lines, the second electrode of the driving transistor may be electrically connected to the anode electrode, and a reference level voltage may be applied to the data lines.

The organic light emitting display device may further include a third voltage supply line, the pixel driving circuit may further include a second capacitor, and wherein the method for driving the organic light emitting diode further comprises changing a voltage level of the gate electrode of the driving transistor after the compensating of the threshold voltage of the driving transistor, at the changing a voltage level of the gate electrode of the driving transistor, one end of the second capacitor may be electrically connected to the third voltage supply line, the gate electrode of the driving transistor may be electrically connected to the second electrode of the driving transistor, the first electrode of the driving transistor may be electrically connected to another end of the second capacitor, and the second electrode of the driving transistor is electrically disconnected from the anode electrode, and a voltage stored in the pixels affects a voltage applied to the gate electrode of the driving transistor.

BRIEF DESCRIPTION OF THE DRAWINGS

Example embodiments will now be described more fully hereinafter with reference to the accompanying drawings. However, they may be embodied in different forms and should not be construed as being limited to the embodiments set forth herein. Rather, these embodiments are provided so that this disclosure will be thorough and complete, and will fully convey the scope of the example embodiments to those skilled in the art.

In the figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
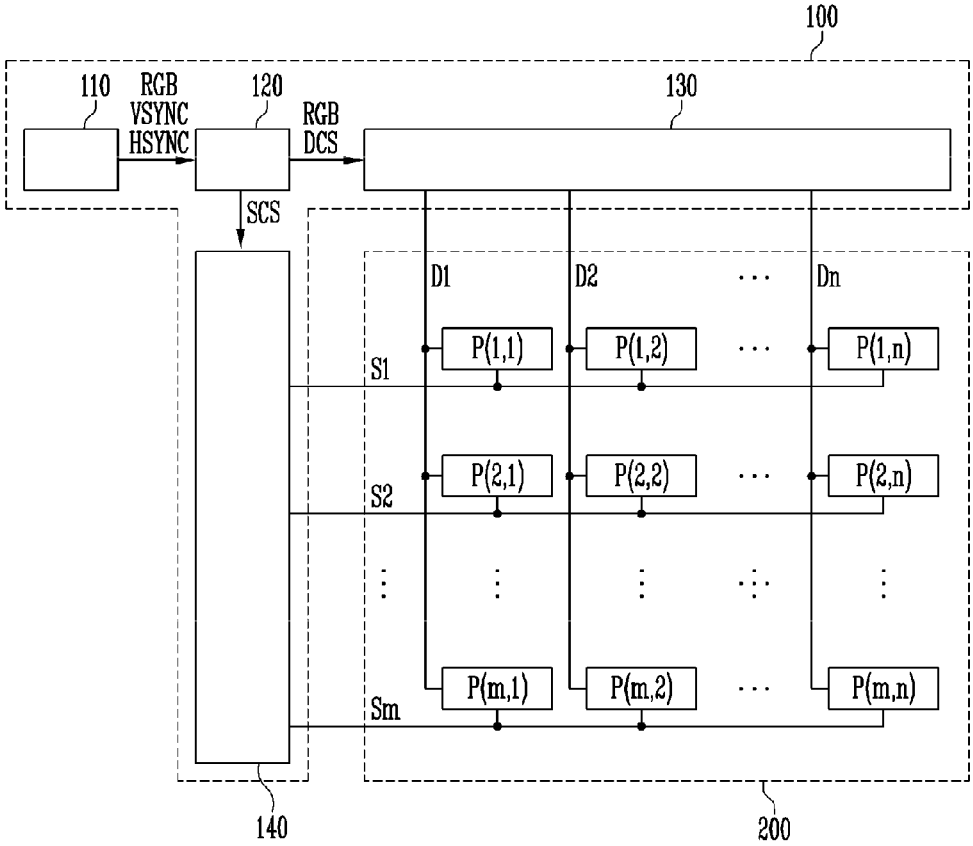
FIG. 1 is a schematic diagram illustrating an organic light emitting display device according to an embodiment of the present disclosure.

Hereinafter, embodiments will be described in greater detail with reference to the accompanying drawings. Embodiments are described herein with reference to cross-sectional illustrations that are schematic illustrations of embodiments (and intermediate structures). As such, variations from the shapes of the illustrations as a result, for example, of manufacturing techniques and/or tolerances, are to be expected. Thus, embodiments should not be construed as being limited to the particular shapes of regions illustrated herein but may include deviations in shapes that result, for example, from manufacturing. In the drawings, lengths and sizes of layers and regions may be exaggerated for clarity. Like reference numerals in the drawings denote like elements.

Terms such as 'first' and 'second' may be used to describe various components, but they should not limit the various components. Those terms are used for the purpose of differentiating a component from other components. For example, a first component may be referred to as a second component, and a second component may be referred to as a first component and so forth without departing from the spirit and scope of the present disclosure. Furthermore, the terms 'and/or' may include any one of or a combination of the components mentioned.

Furthermore, a singular form may include a plural from as long as it is not specifically mentioned in a sentence. Furthermore, "include/comprise" or "including/comprising" as used in the specification represents that one or more components, steps, operations, and elements may exist or are added.

Furthermore, unless defined otherwise, all the terms used in this specification including technical and scientific terms have the same meanings as would be generally understood by those skilled in the related art. The terms defined in generally used dictionaries should be construed as having the same meanings as would be construed in the context of the related art, and unless clearly defined otherwise in this specification, these terms should not be construed as having idealistic or overly formal meanings.

It is also noted that in this specification, "connected/coupled" refers to one component not only directly coupled or connected to another component but also indirectly coupled or connected to another component through an intermediate component. On the other hand, "directly connected/directly coupled" refers to one component directly coupling another component without an intermediate component.

FIG. 1 is a schematic diagram illustrating an organic light emitting display device according to an embodiment of the present disclosure. Referring to FIG. 1, the organic light emitting display device includes a driver 100 and a display panel 200. The driver 100 may include a host 110, timing controller 120, data driver 130, and scan driver 140. The display panel 200 includes pixels (P(1,1) to P(m,n), hereinafter referred to as P), and scan lines (S1 to Sm, m being a positive integer) and data lines (D1 to Dn, n being a positive integer) electrically connected to the pixels (P). Detailed structures of the pixels (P) and illustrations of a first voltage supply line to a third voltage supply line electrically connected to the pixels (P) are omitted from FIG. 1.

The host 110 receives an electric signal from outside and provides the electric signal to the controller 120. The host 110 may provide to the timing controller 120, image data (RGB), a vertical sync signal (VSYNC) and a horizontal sync signal (HSYNC), all inputs from an external video source device, which may include a system on chip where a scaler is embedded.

The timing controller 120 receives sync signals (VSYNC, HSYNC) from the host 110, and generates timing control signals (DCS, SCS) for controlling timing of operation of the data driver 130 and the scan driver 140. Furthermore, the timing controller 120 outputs the image data (RGB) to the data driver 130 so that the display panel 200 may display an image.

The data driver 130 latches the image data (RGB) input from the timing controller 120 in response to a data timing control signal (DCS). The data driver 130 may include a plurality of source driver ICs. The data driver 130 applies data voltages that are based on the image data (RGB) to data lines (D1 to Dn).

The scan driver 140 applies a scan signal to the scan lines (S1 to Sm) sequentially in response to the scan timing control signal (SCS), at every frame.

Figure 2:
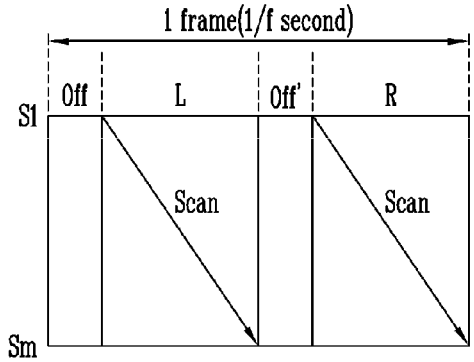
FIG. 2 is a view for explaining a method for driving an organic light emitting display device according to an embodiment of the present disclosure.

FIG. 2 is a view for explaining a method for driving an organic light emitting display device according to an embodiment of the present disclosure. Referring to FIGS. 1 and 2, the organic light emitting display device displays f frame(s) in 1 second, 1/f second being allocated to each frame. Each frame includes a step of stopping displaying (Off), a step of displaying a left eye image (L), a step of stopping displaying (Off'), and a step of displaying a right eye image(R). f is a positive integer such as, for example, 60 (60 frames).

At the steps of stopping displaying (Off, Off'), a voltage having a first level is applied to a cathode electrode of an organic light emitting diode. The first level is set to be higher than a voltage level being applied to an anode electrode of the organic light emitting diode, and thus the voltage level of the cathode electrode becomes higher than the voltage level of the anode electrode. Therefore, the pixels (P(1,1) to P(m,n)) do not emit light. For convenience of explanation, the first level may be assumed to be higher than the highest value of the voltage levels that are applied to a driving transistor of a typical organic light emitting display device. However, this is just an example. For at least a certain period of the steps of stopping displaying (Off, Off'), the voltage level stored in the pixels (P(1,1) to P(m,n)) affects the voltage level being applied to a gate electrode of the driving transistor in the pixels (P(1,1) to P(m,n)). During the steps of stopping displaying (Off, Off'), the driving transistor may change to an off state, the voltage level of the anode electrode of the organic light emitting diode may be initialized, or a threshold voltage of the driving transistor may be compensated.

At the steps of displaying an image (L, R), a voltage having a second level is applied to the cathode electrode of the organic light emitting diode, and thus the voltage level of the cathode electrode may be higher than the voltage level of the anode electrode. The second level may correspond to the voltage level being applied to the cathode electrode of the organic light emitting diode inside a general organic light emitting display device. The brightness in which each pixel (P) emits light is based on the voltage level of the gate electrode of the driving transistor included in each pixel (P). For at least a certain period of time of the steps of displaying an image (L, R), a scan signal may be applied to at least some of the scan lines (S1 to Sm). When the scan signal is applied, the voltage being applied to the data lines (D1 to Dn) may be stored in the pixels (P(1,1) to P(m,n)). Then, for at least a certain period of time of the steps of stopping displaying (Off, Off'), the voltage stored in each pixel affects the voltage being applied to the gate electrode of the driving transistor included in each pixel. For example, after the steps of stopping displaying (Off, Off') end, the voltage level being applied to the gate electrode of each driving transistor may be expressed as a function of the voltage level that was stored in each pixel.

In an organic light emitting display device according to an embodiment of the present disclosure, at the steps of displaying an image (L, R), a scan signal is applied and the voltages that are applied to the data lines (D1 to Dn) are stored in the pixels (P). For at least a certain period of time of the steps of stopping displaying (Off, Off'), the voltage of the gate electrode of the driving transistor is affected. Furthermore, the steps of stopping displaying (Off, Off') may be set to be much shorter than the steps of displaying an image (L, R). For example, in a case where the steps of stopping displaying (Off, Off') accounts for 20% of frame period 1, the organic light emitting diode being driven in a 3D display method according to the embodiment of the present disclosure may emit light with a brightness that is 1.25 times that of a brightness of an organic light emitting diode that is driven according to a general method in order to emit light having an average brightness that is the same as in the general method. Therefore, a life span of each organic light emitting diode may be extended. Detailed structure and driving method of each pixel (P) will be explained in more detail hereinafter with reference to FIGS. 3 to 8.

Figure 3:
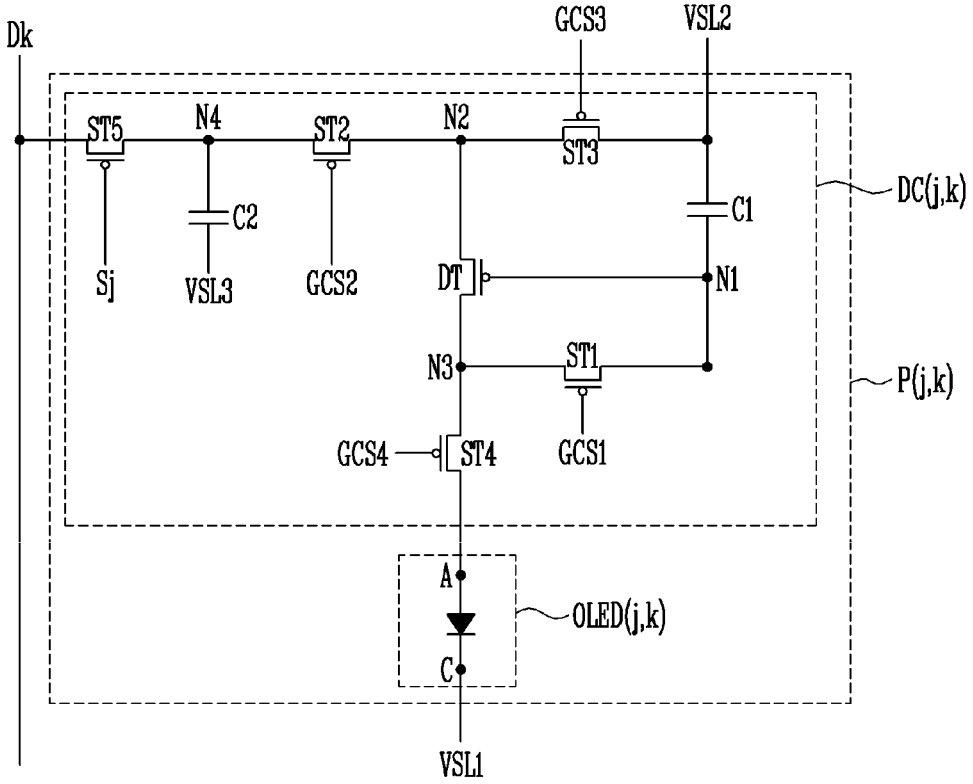
FIG. 3 is a view for explaining an embodiment of the pixel illustrated in FIG. 1.

FIG. 3 is a view for explaining an embodiment of each pixel of the organic light emitting display device illustrated in FIG. 1. FIG. 3 representatively illustrates pixels (P(j,k, j and k being positive integers)) electrically connected to a scan line (Sj) and data line (Dk).

Referring to FIG. 3, the pixel (P(j,k)) includes an organic light emitting diode (OLED(j,k)) and a pixel driving circuit (DC(j,k)) that outputs a driving current to the organic light emitting diode (OLED(j,k)). The pixel (P(j,k)) is electrically connected to a first voltage supply line (VSL1), a second voltage supply line (VSL2), and a third voltage supply line (VSL3). The pixel driving circuit (DC(j,k)) includes a driving transistor (DT), a first transistor (ST1), a second transistor (ST2), a third transistor (ST3), a fourth transistor (ST4), a fifth transistor (ST5), a first capacitor (C1) and a second capacitor (C2).

A gate electrode of the driving transistor (DT) is connected to a first node (N1), a first electrode of the driving transistor is connected to a second node (N2), and a second electrode of the driving transistor is connected to a third node (N3). Herein, the first electrode may be a source electrode or a drain electrode, and the second electrode may be the other one of the source and drain electrodes. For example, in a case where the first electrode is a drain electrode, the second electrode may be a source electrode, or vice versa. Definitions of the first electrode and the second electrode may apply to first through fifth transistors (ST1 to ST5) that will be explained hereinafter.

To the gate electrode of the first transistor (ST1), a first control signal (GCS1) is applied, the first electrode is connected to the first node (N1), and the second electrode is connected to the third node (N3).

To the gate electrode of the second transistor (ST2), a second signal (GCS2) is applied, the first electrode is connected to the fourth node (N4), and the second electrode is connected to the second node (N2).

To the gate electrode of the third transistor (ST3), a third control signal (GCS3) is applied, the first electrode is connected to the second voltage supply line (VSL2), and the second electrode is connected to the second node (N2).

To the gate electrode of the fourth transistor (ST4), a fourth control signal (GCS4) is applied, the first electrode is connected to the third node (N3), and the second electrode is connected to the anode electrode (A) of the organic light emitting diode (OLED(j,k)).

The gate electrode of the fifth transistor (ST5) is connected to one of the scan lines (Sj), the first electrode is connected to one of the data lines (Dk), and the second electrode is connected to the fourth node (N4).

One end of the first capacitor (C1) is connected to the second voltage supply line (VSL2), and another end is connected to the first node (N1).

One end of the second capacitor (C2) is connected to the third voltage supply line (VSL3), and another end is connected to the fourth node (N4).

The anode electrode (A) of the organic light emitting diode (OLED(j,k)) is connected to the second electrode of the fourth transistor (ST4), and the cathode electrode (C) is electrically connected to the first voltage supply line (VSL1).

Figure 4:
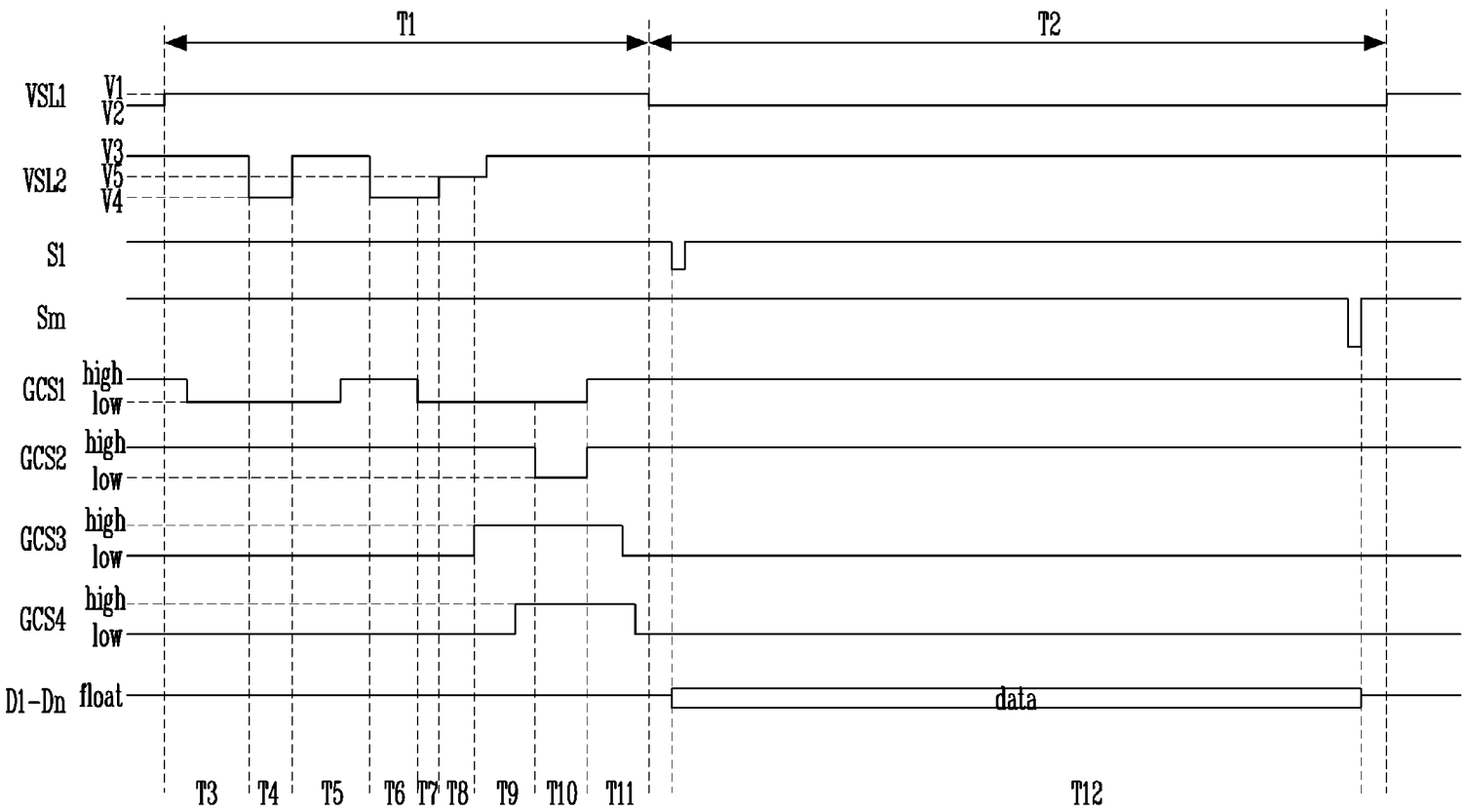
FIG. 4 is a view for explaining a method for driving the pixel illustrated in FIG. 3.

FIG. 4 is a view for explaining a method for driving the pixel illustrated in FIG. 3. Referring to FIGS. 3 and 4, a first level voltage (V1) is applied to the first voltage supply line (VSL1) during a first period (T1), and thus the organic light emitting diode (OLED(j,k)) in the pixel (P(j,k)) does not emit light, thereby stopping the displaying. The first period (T1) may correspond to the steps of stopping displaying (Off, Off') of FIG. 2. During a second period (T2), a second level voltage (V2) is applied to the first voltage supply line (VSL1), and thus the organic light emitting diode (OLED (j,k)) in the pixel (P(j,k)) may emit light. The second period (T2) may correspond to the steps of displaying an image (L, R) of FIG. 2. The first period (T1) includes a third period to an eleventh period (T3 to T11), and the second period (T2) includes a twelfth period (T12). During the first period (T1), the data lines (D1 to Dn) may be floated.

In FIG. 4, in a case where the first control signal (GCS1) is a high level signal, the first transistor (ST1) is turned off in response to the first control signal (GCS1) applied to the gate electrode. In a case where the first control signal (GCS1) is a low level signal, the first transistor (ST1) is turned on in response to the first control signal (GCS1) applied to the gate electrode. Likewise, in the cases of the second to fourth control signals (GCS2 to GCS4), it is possible to control the state of the second to fourth transistors (ST2 to ST4). At the first and second periods (T1, T2), a certain level of the voltage may be applied to the third voltage supply line (VSL3). However, operations of the transistors (ST1 to ST4) and the level of voltage being applied to the third supply line (VSL3) according to the control signals (GCS1 to GCS4) are merely examples.

At the start of the third period (T3), the level of the voltage being applied to the first voltage supply line (VSL1) changes to a first level (V1), and thus the organic light emitting diode (OLED(j,k)) stops emitting light. The level of the voltage being applied to the second voltage supply line (VSL2) does not change but maintains the third level (V3), the first and second control signals (GCS1, GCS2) are high level signals, and the third and fourth control signals (GCS3, GCS4) are low level signals. The first and second transistors (ST1, ST2) are turned off, and the third and fourth transistors (ST3, ST4) are turned on. The second node (N2) is electrically connected to the second voltage supply line (VSL2), and the third node (N3) is electrically connected to the anode electrode (A). Therefore, since the first voltage supply line (VSL1) is connected to all of the pixels (P), all organic light emitting diodes stop emitting light. The third level (V3) may correspond to or may be substantially the same level as the first level (V1).

After the voltage level being applied to the first voltage supply line (VSL1) changes to a first level (V1), the first control signal (GCS1) may change to a low level signal. After the first control signal (GCS1) changes to the low level signal, the second control signal (GCS2) changes to a high level signal, and the first, third, and fourth control signals (GCS1, GCS3, GCS4) changes to low level signals. Therefore, the second transistor (ST2) is turned off, and the first, third and fourth transistors (ST1, ST3, ST4) are turned on. The second node (N2) is electrically connected to the second voltage supply line (VSL2), and the first and third nodes (N1, N3) are electrically connected to the anode electrode (A).

At the fourth period (T4), the voltage level being applied to the second voltage supply line (VSL2) becomes a fourth level (V4) that is lower than the first level (V1), and thus the driving transistor (DT) comes to an off state. The fourth level (V4) may correspond to or may be substantially the same as the second level (V2). At the fourth period (T4), the second control signal (GCS2) is a high level signal, and the first, third and fourth control signals (GCS1, GCS3, GCS4) are low level signals, and thus the second transistor (ST2) is turned off, and the first, third and fourth transistors (ST1, ST3, ST4) are turned on. The first and third nodes (N1, N3) are electrically connected to the anode electrode (A), and a fourth level voltage (V4) is applied to the second node (N2).

At the start of the fifth period (T5), the voltage level being applied to the second voltage supply line (VSL2) changes to a third level (V3) again. The second control signal (GCS2) is a high level signal, and the first, third and fourth control signals (GCS1, GCS3, GCS4) are low level signals, and thus the second transistor (ST2) is turned off, and the first, third and fourth transistors (ST1, ST3, ST4) are turned on. The first and third nodes (N1, N3) are electrically connected to the anode electrode (A), and a third level voltage (V3) is applied to the second node (N2).

After the voltage level being applied to the second voltage supply line (VSL2) changes to a third level (V3), the first control signal (GCS2) may change to a high level signal. After the first control signal (GCS1) changes to the high level signal, the first and second control signals (GCS1, GCS2) are high level signals, and the third and fourth control signals (GCS3, GCS4) are low level signals. The first and second transistors (ST1, ST2) are turned off, and the third and fourth transistors (ST3, ST4) are turned on. A first level voltage is applied to the second node (N2), and the third node (N3) is electrically connected to the anode electrode (A).

At the sixth period (T6), the voltage level being applied to the second voltage supply line (VSL2) changes to a fourth level (V4), and thus the voltage level of the anode electrode (A) changes (e.g., initialized). During the sixth period (T6), the first and second control signals (GCS1, GCS2) are high level signals, and the third and fourth control signals (GCS3, GCS4) are low level signals, and thus the first and second transistors (ST1, ST2) are turned off, and the third and fourth transistors (ST3, ST4) are turned on. A second level voltage (V2) is applied to the second node (N2), and the third node (N3) is electrically connected to the anode electrode (A).

At the seventh period (T7), since the first control signal (GCS1) changes to a low level signal, due to the electrical connection with the third node (N3), the voltage level of the first node (N1) changes (e.g., initialized). Since the first node (N1) and the third node (N3) are electrically connected, the driving transistor (DT) may operate like a diode. The second control signal (GCS2) is a high level signal, and the first, third, and fourth control signals (GCS1, GCS3, GCS4) are low level signals. Therefore, the second transistor (ST2) is turned off, and the first, third, and fourth transistors (ST1, ST3, ST4) are turned on. The first and third nodes (N1, N3) are electrically connected to the anode electrode (A), and a fourth level voltage (V4) is applied to the second node (N2).

At the eighth period (T8), the voltage level being applied to the second voltage supply line (VSL2) changes to a fifth level (V5). At the eighth period (T8), the second control signal (GCS2) is a high level signal, and the first, third, and fourth control signals (GCS1, GCS3, GCS4) are low level signals. Therefore, the second transistor (ST2) is turned off, and the first, third, and fourth transistors (ST1, ST3, ST4) are turned on. The first and third nodes (N1, N3) are electrically connected to the anode electrode (A), and the first node (N1) and the third node (N3) are electrically connected to each other, and thus the driving transistor (DT) may operate like a diode. A fifth level voltage (V5) is applied to the second node (N2). In some embodiments, the fifth level (V5) is between the third level (V3) and the fourth level (V4), and lower than the minimum level of the voltage being applied to the data lines (D1 to Dn). During at least a certain period of the eighth period (T8), a current from the second voltage supply line (VSL2) arrives at the first node (N1) via the second node (N2), and third node (N3). The voltage level being applied to the first node (N1) increases until the driving transistor (DT) comes to an off state. Since the driving transistor (DT) comes to an off state when a difference of voltage between the first electrode and the gate electrode reaches a threshold voltage (Vth), a difference of voltage between the first node (N1) and the second node (N2) becomes a threshold voltage (Vth). Since all of the pixels (P) are compensated with the threshold voltage at the same time, the compensation may be conducted for an ample period of time. In FIG. 4, the fourth transistor (ST4) is turned on and thus the third node (N3) is electrically connected to the anode electrode (A). However, even if the fourth transistor (ST4) is turned off, it may be compensated with the threshold voltage.

At the start of the ninth period (T9), since the third control signal (GCS3) changes to a high level signal, the third transistor (ST3) is turned off, and compensation of the threshold voltage (Vth) ends. The second and third control signals (GCS2, GCS3) are high level signals, and the first and fourth control signals (GCS1, GCS4) are low level signals. Therefore, the second and third transistors (ST2, ST3) are turned off, and the first and fourth transistors (ST1, ST4) are turned on. The first and third nodes (N1, N3) are electrically connected to the anode electrode (A), and the second node (N2) is electrically floated.

After the third control signal (GCS3) changes to a high level signal, the voltage level being applied to the second voltage supply line (VSL2) may change to a third level (V3), and the fourth control signal (GCS4) may change to a high level signal as well. In such a case, when the ninth period (T9) ends, the second to fourth control signals (GCS2 to GCS4) are high level signals, and the first control signal (GCS1) is a low level signal. Therefore, the second to fourth transistors (ST2 to ST4) are turned off, and the first transistor (ST1) is turned on. Since the first node (N1) is electrically connected with the third node (N3), it operates like a diode. The voltage level that was at the fourth node (N4) (e.g., corresponding to a charge stored in the second capacitor (C2)) during the third to ninth periods (T3 to T9) is the voltage level (Vdata) that was applied to the data line (Dk) before the start of the first period (T1). A difference of voltage level between the first node (N1) and the second node (N2) maintains the threshold voltage (Vth).

During the tenth period (T10), since the second control signal (GCS2) changes to a low level signal, the second transistor (ST2) is turned on. The first and second transistors (ST1, ST2) are turned on, and the third and fourth transistors (ST3, ST4) are turned off. The second node (N2) and fourth node (N4) are electrically connected to each other, and the first node (N1) and third node (N3) are electrically connected to each other. Since the first node (N1) and third node (N3) are electrically connected to each other, the driving transistor (DT) may operate like a diode having the threshold voltage (Vth).

In a case where two nodes (N2, N4) having different voltage levels are electrically connected to each other, by the law of conservation of electric charge, even when the second transistor (ST2) is turned on, the electric charge conserved in the first capacitor (C1) and second capacitor (C2) does not change. Since the voltage level being applied to the third voltage supply line (VSL3), voltage level (V3) being applied to the second voltage supply line (VSL2), and the difference of voltage level (Vth) between the first node (N1) and the second node (N2) do not change, they are offset. Therefore, they may be expressed according to mathematical formula 1 below.

$$C_1V_5+C_2V_{data}=C_1V_{N2}+C_2V_{N2} \quad \text{Formula 1}$$

($C_1$: capacitance of the first capacitor (C1), $C_2$: capacitance of the second capacitor (C2), Vdata: voltage level of the fourth node (N4) during the third to ninth periods (T3 to T9), V5: the fifth level, VN2: the voltage level of the second node (N2) after the second transistor (ST2) is turned on)

Mathematical formula 2 is shown below.

$$V_{N2} = \frac{C_1V_5 + C_2V_{data}}{C_1 + C_2} \quad \text{Formula 2}$$

Herein, since the voltage level of the second node (N2) has been determined, and the driving transistor (DT) operates like a diode having the threshold voltage (Vth), the voltage level of the first node (N1) is as shown in mathematical formula 3 below.

$$V_{N1} = \frac{C_1V_5 + C_2V_{data}}{C_1 + C_2} - V_{th} \quad \text{Formula 3}$$

(VN1: voltage level of the first node (N1) after the second transistor (ST2) is turned on, Vth: the threshold voltage of the driving transistor (DT)).

Therefore, the voltage stored at the fourth node (N4) (e.g., corresponding to a charge stored in the second capacitor (C2)) during the third to ninth periods (T3 to T9) affects the voltage being applied to the first node (N1). That is, the voltage level (VN1) being applied to the gate electrode of the driving transistor (DT) during the tenth period (T10) to eleventh period (T11) may be expressed as a function of the voltage level (Vdata) stored in the fourth node (N4) during the third to ninth periods (T3 to T9).

At the start of the eleventh period (T11), since the first and second control signals (GCS1, GCS2) change to high level signals, the first to fourth transistors (ST1 to ST4) are all turned off. The fourth node (N4) is electrically disconnected from the second node (N2), and the voltage of the first node (N1) does not change. FIG. 4 illustrates that the first and second control signals (GCS1, GCS2) change to high level signals at the same time, but the second control signal (GCS2) may change to a high level signal after the first control signal (GCS1) changes to a high level.

After the first and second control signals (GCS1, GCS2) change to high level signals, the third and fourth control signals (GCS3, GCS4) may change to low level signals. In such a case, when the eleventh period ends, the first and second transistors (ST1, ST2) are turned off, and the third and fourth transistors (ST3, ST4) are turned on. Since the second node (N2) is electrically connected to the second voltage supply line (VSL2) and thus a third level voltage (V3) is applied, the third node (N3) is electrically connected to the anode electrode (A).

Since at the start of the second period (T2), a second level voltage (V2) is applied to the first voltage supply line (VSL1), the organic light emitting diode (OLED(j,k)) may emit light. Herein, the level (I) of the current being output to the organic light emitting diode (OLED(j,k)) may be shown in mathematical formula 4 below.

$$\begin{aligned} I &= k\left\{\left(V_1 - \left(\frac{C_1V_5 + C_2V_{data}}{C_1 + C_2} - V_{th}\right)\right) - V_{th}\right\}^2 \\ &= k\left(V_1 - \frac{C_1V_5 + C_2V_{data}}{C_1 + C_2}\right)^2 \end{aligned} \quad \text{Formula 4}$$

(k: proportional constant)

The brightness in which the organic light emitting diode (OLED(j,k)) emits light is proportional to the level (I) of the current, and thus is not affected by the threshold voltage (Vth). For at least a certain period of time of the second period (T2), a scan signal may be applied to at least some of the scan lines of the scan lines (S1 to Sm). In the embodiment illustrated in FIG. 4, during the twelfth period (T12) of the second period (T2), a scan signal is sequentially applied to all the scan lines (S1 to Sm). At the start of the twelfth period (T12), application of the scan signal starts in the scan line (S1), and at the end of the twelfth period (T12), application of the scan signal ends in the scan line (Sm). During a certain period of time during the twelfth period, the scan signal is applied to the scan line (Sj), the voltage being applied to the data line (Dk) is stored in the fourth node (N4)

in the pixel (P(j,k)). Since the second control signal (GCS2) is a high level signal, and the second transistor (ST2) is turned off, the voltage at the fourth node (N4) (e.g., corresponding to a charge stored in the second capacitor (C2)) does not affect the driving transistor (DT) during the second period (T2).

In a case where the second period (T2) ends, and a first level voltage (V1) is applied to the first voltage supply line (VSL1), the organic light emitting diode (OLED(j,k)) does not emit light similarly as in the third period (T3). Furthermore, the voltage being applied to the fourth node (N4) during the second period (T2) affects the voltage of the first node (N1). In the embodiment explained hereinabove, a scan signal is applied to all scan lines (S1 to Sm) during the second period (T2), but the scan signal may be applied to some of the scan lines (S1 to Sm) even after the start of the eleventh period (T11) but before the start of the second period (T2).

Figure 5:
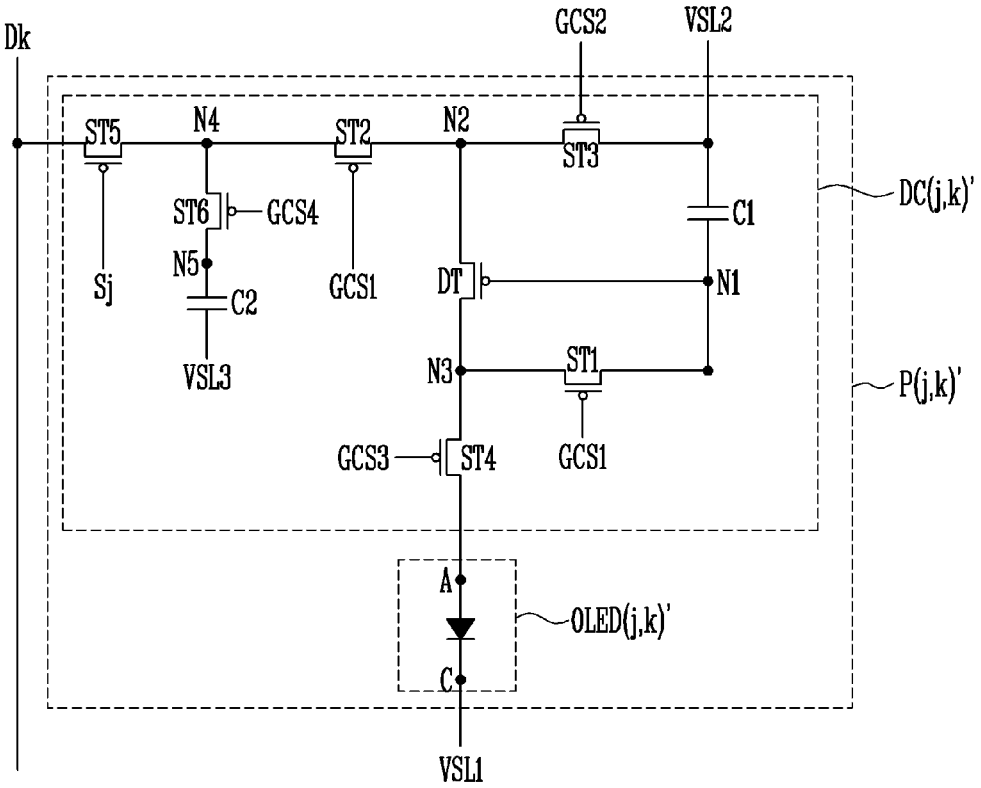
FIG. 5 is a view for explaining another embodiment of the pixel illustrated in FIG. 1.

FIG. 5 is a schematic view according to another embodiment of each pixel of the organic light emitting display device illustrated in FIG. 1. FIG. 5 representatively illustrates a pixel (P(j,k, j and k being positive integers)') electrically connected to a scan line (Sj) and data line (Dk).

Referring to FIG. 5, the pixel (P(j,k)') includes a pixel driving circuit (DC(j,k)') and an organic light emitting diode (OLED(j,k)'). The pixel driving circuit (DC(j,k)') includes a driving transistor (DT), first to sixth transistor (ST1 to ST6), and first and second capacitor (C1, C2). The driving transistor (DT), first transistor (ST1), fifth transistor (ST5) and first capacitor (C1) of the pixel (P(j,k)') are the same as the driving transistor (DT), first transistor (ST1), fifth transistor (ST5), and first capacitor (C1) explained with reference to FIG. 3, and thus further explanation may be omitted.

To the gate electrode of the second transistor (ST2), the first control signal (GCS1) is applied just as the gate electrode of the first transistor (ST1), and the first electrode is connected to the fourth node (N4), and the second electrode is connected to the second node (N2). Herein, the first electrode may be a source electrode or drain electrode, and the second electrode may be the other one of the source and drain electrodes. For example, when the first electrode is a drain electrode, the second electrode may be a source electrode, or vice versa. Definitions of the first electrode and second electrode may each be applied to third to sixth transistors (ST3 to ST6), which will be explained hereinafter.

To the gate electrode of the third transistor (ST3), the second control signal (GCS2) is applied, the first electrode is connected to the second voltage supply line (VSL2), and the second electrode is connected to the second node (N2).

To the gate electrode of the fourth transistor (ST4), the third control signal (GCS3) is applied, the first electrode is connected to the third node (N3), and the second electrode is connected to the anode electrode (A).

To the gate electrode of the sixth transistor (ST6), the fourth control signal (GCS4) is applied, the first electrode is connected to the fourth node (N4), and the second electrode is connected to the fifth node (N5).

One end of the second capacitor (C2) is connected to the third voltage supply line (VSL3), and another end is connected to the fifth node (N5).

The anode electrode (A) of the organic light emitting (OLED(j,k)') is connected to the second electrode of the fourth transistor (ST4), and the cathode electrode (C) is electrically connected to the first voltage supply line (VSL1).

Figure 6:
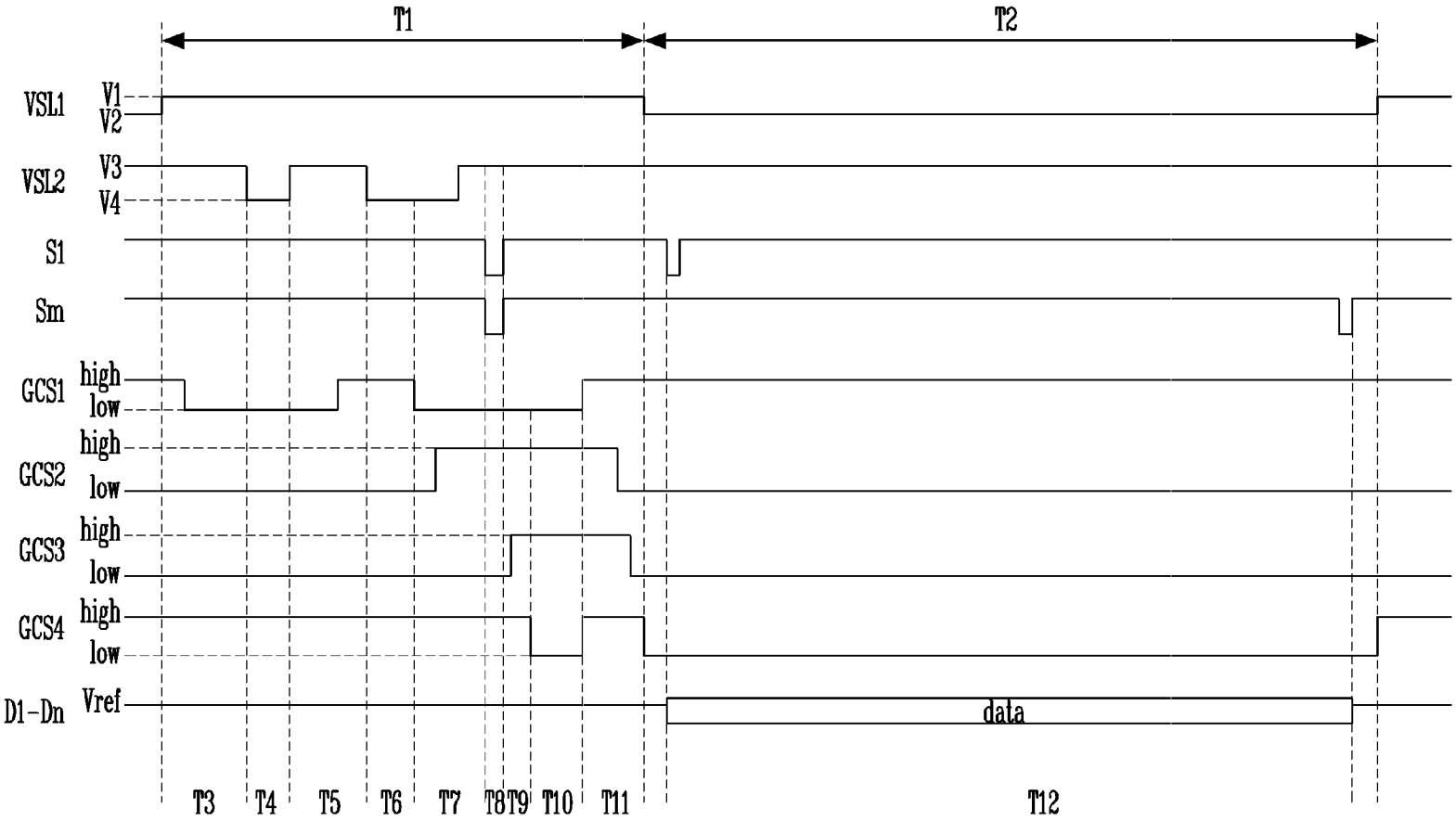
FIG. 6 is a view for explaining a method for driving the pixel illustrated in FIG. 5.

FIG. 6 is a view for explaining a method for driving a pixel illustrated in FIG. 5. Referring to FIGS. 5 and 6, during the first period (T1), a first level voltage (V1) is applied to the first supply line (VSL1), and thus the organic light emitting diode (OLED(j,k)') in the pixel (P(j,k)') does not emit light, thereby stopping displaying. The first period (T1) may correspond to the steps of stopping displaying (Off, Off') of FIG. 2. During the second period (T2), a second level voltage (V2) is applied to the first voltage supply line (VSL1), and thus the organic light emitting diode (OLED (j,k)') in the pixel (P(j,k)') may emit light. The second period (T2) may correspond to the steps of displaying an image (L, R) of FIG. 2. The first period (T1) including a third to a eleventh period (T3 to T11), and the second period (T2) including a twelfth period (T12) are the same as the aforementioned explanation with reference to FIGS. 3 and 4. At the first period (T1), to data lines (D1 to Dn), a voltage having a reference level (Vref) may be applied.

In FIG. 6, when the first control signal (GCS1) is a high level signal, the first and second transistors (ST1, ST2) where the first control signal (GCS1) is applied to the gate electrode are turned off. When the first control signal (GCS1) is a low level signal, the first and second transistors (ST1, ST2) where the first control signal (GCS1) is applied to the gate electrode are turned on. The second to fourth control signals (GCS2 to GCS4) may also control the state of the third, fourth and sixth transistors (ST3, ST4, ST6), respectively. At the first and second periods (T1, T2), a same voltage level may be applied to the third voltage supply line (VSL3). However, operations of the transistors (ST1, ST2, ST3, ST4, ST6) and the voltage level being applied to the third supply line (VSL3) according to the control signals (GCS1 to GCS4) are merely examples.

At the start of the third period (T3), the voltage level that is applied to the first voltage supply line (VSL1) changes to a first level (V1), and thus the organic light emitting diode (OLED(j,k)') stops emitting light. The voltage level that is applied to the second voltage supply line (VSL2) maintains a third level (V3) during the third period (T3). The first voltage supply line (VSL1) is connected to all the pixels (P), and thus all of the organic light emitting diodes stop emitting light. The third level (V3) may correspond to or may be substantially the same as the first level (V1). The first and fourth control signals (GCS1, GCS4) are high level signals, and the second and third control signals (GCS2, GCS3) are low level signals. The first, second and sixth transistors (ST1, ST2, ST6) are turned off, and the third and fourth transistors (ST3, ST4) are turned on. The second node (N2) is electrically connected to the second voltage supply line (VSL2), and thus a voltage having a third level (V3) is applied. The third node (N3) is electrically connected to the anode electrode (A).

After the voltage level that is applied to the first voltage supply line (VSL1) changes to a first level (V1), the first control signal (GCS1) may change to a low level signal. The fourth control signal (GCS4) is a high level signal, and the first to third control signals (GCS1 to GCS3) are low level signals. Therefore, the sixth transistor (ST6) is turned off, and the first to fourth transistors (ST1 to ST4) are turned on. The second and fourth nodes (N2, N4) are electrically connected to the second voltage supply line (VSL2), and the first and third nodes (N1, N3) are electrically connected to the anode electrode (A). Since the first node (N1) and the third node (N3) are electrically connected to each other, the driving transistor (DT) may operate like a diode.

At the fourth period (T4), the voltage level that is applied to the second voltage supply line (VSL2) becomes a fourth level (V4) which is lower than the first level (V1), and thus the driving transistor (DT) comes to an off state. The fourth level (V4) may correspond or may be substantially the same as the second level (V2). At the fourth period (T4), the fourth control signal (GCS4) is a high level signal, and the first to third control signals (GCS1 to GCS3) are low level signals. Therefore, the sixth transistor (ST6) is turned off, and the first to fourth transistors (ST1 to ST4) are turned on. The first and third nodes (N1, N3) are electrically connected to the anode electrode (A), and a fourth level voltage (V4) is applied to the second and fourth nodes (N2, N4).

At the start of the fifth period (T5), the voltage level being applied to the second voltage supply line (VSL2) changes to a third level (V3). The fourth control signal (GCS4) is a high level signal, and the first to third control signals (GCS1 to GCS3) are low level signals. Therefore, the sixth transistor (ST6) is turned off, and the first to fourth transistors (ST1 to ST4) are turned on. The first and third nodes (N1, N3) are electrically connected to the anode electrode (A), and a fourth level voltage (V4) is applied to the second and fourth nodes (N2, N4).

After the voltage level being applied to the second voltage supply line (VSL2) changes to a third level (V3), the first control signal (GCS1) may change to a high level signal. In this case, when the fifth period (T5) ends, the first and fourth control signals (GCS1, GCS4) are high level signals, and the second and third control signals (GCS2, GCS3) are low level signals, and thus the first, second and sixth transistors (ST1, ST2, ST6) are turned off, and the third and fourth transistors (ST3, ST4) are turned on. A third level voltage (V3) is applied to the second node (N2), and the third node (N3) is electrically connected to the anode electrode (A).

At the sixth period (T6), the voltage level being applied to the second voltage supply line (VSL2) changes to a fourth level (V4), and thus the voltage level of the anode electrode (A) changes (e.g., is initialized). During the sixth period (T6), the first and fourth control signals (GCS1, GCS4) are high level signals, and the second and third control signals (GCS2, GCS3) are low level signals, and thus the first, second and sixth transistors (ST1, ST2, ST6) are turned off, and the third and fourth transistors (ST3, ST4) are turned on. A fourth level voltage (V4) is applied to the second node (N2), and the third node (N3) is electrically connected to the anode electrode (A).

At the start of the seventh period (T7), the first control signal (GCS1) changes to a low level signal, and thus the first node (N1) is electrically connected to the third node (N3). Due to the electrical connection with the third node (N3), the voltage level of the first node (N1) changes (e.g., is initialized). After the first control signal (GCS1) changes to a low level signal, the second control signal (GCS2) may change to a high level signal, and then a third level voltage (V3) may be applied to the second voltage supply line (VSL2). In this case, when the seventh period (T7) ends, the second and fourth control signals (GCS2, GCS4) are high level signals, and the first and third control signals (GCS1, GCS3) are low level signals. Therefore, the third and sixth transistors (ST3, ST6) are turned off, and the first, second, and fourth transistors (ST1, ST2, ST4) are turned on. The first and third nodes (N1, N3) are electrically connected to the anode electrode (A), and the second node (N2) and fourth node (N4) are electrically connected to each other. During the third to seventh periods (T3 to T7), a scan signal is not applied, and thus the fifth transistor (ST5) maintains an off state. Since the first node (N1) and the third node (N3) are electrically connected to each other, the driving transistor (DT) may operate like a diode.

At the eighth period (T8), a scan signal is applied to all of the scan lines (S1 to Sm), and a voltage having a reference level (Vref) is applied to all of the data lines (D1 to Dn). Therefore, the fifth transistor (ST5) is turned on, and the voltage level of the fourth node (N4) changes to a reference level (Vref). During the eighth period (T8), the second and fourth signals (GCS2, GCS4) are high level signals, and the first and third control signals (GCS1, GCS3) are low level signals. Therefore, the third and sixth transistors (ST3, ST6) are turned off, and the first, second and fourth transistors (ST1, ST2, ST4) are turned on. The first and third nodes (N1, N3) are electrically connected with the anode electrode (A), and a voltage of a reference level (Vref) is applied to the second and fourth nodes (N2, N4). Since the first node (N1) and the third node (N3) are electrically connected to each other, the driving transistor (DT) may operate like a diode. In the case of the pixel driving circuit (DC(j,k)'), current flows from the data line (Dk) and reaches the first node (N1) via the fourth node (N4), second node (N2), and third node (N3). The voltage level being applied to the first node (V1) increases until the driving transistor (DT) reaches an off state. When the difference voltage level between the first electrode and the gate electrode reaches the threshold voltage (Vth), the driving transistor (DT) comes to an off state, and thus the voltage level being applied to the first node (N1) becomes lower than the reference level (Vref) by as much as the threshold voltage (Vth). In FIG. 6, the fourth transistor (ST4) is turned on and thus the third node (N3) is electrically connected to the anode electrode (A), but the fourth transistor (ST4) may be compensated with the threshold voltage even when it is turned off. During the eighth period (T8), a voltage having a reference level (Vref) must be applied to all the data lines (D1 to Dn), and a voltage having a reference level (Vref) during the third to eleventh periods (T3 to T11) may be applied to the data lines (D1 to Dn).

At the start of the ninth period (T9), application of a scan signal stops, and thus the fifth transistor (ST5) is turned off, and threshold voltage compensation also stops. The second and fourth control signals (GCS2, GCS4) are high level signals, and the first and third control signals (GCS1, GCS3) are low level signals. Therefore, the third and sixth transistors (ST3, ST6) are turned off, and the first, second, and fourth transistors (ST1, ST2, ST4) are turned on.

After the application of a scan signal stops, the third control signal (GCS3) may change to a high level signal. In this case, when the ninth period (T9) ends, the second to fourth control signals (GCS2 to GCS4) are high level signals, and the first control signal (GCS1) is a low level signal. The first node (N1) is electrically connected with the third node (N3), and the second node (N2) is electrically connected with the fourth node (N4). Since the first node (N1) and the third node (N3) are electrically connected to each other, the driving transistor (DT) may operate like a diode. During the third to ninth periods (T3 to T9), the voltage level at the fifth node (N5) (e.g., corresponding to a charge stored in the second capacitor (C2)) is the voltage level that was applied to the data line (Dk) before the start of the first period (T1). The difference of voltage level between the first node (N1) and the second node (N2) is the threshold voltage (Vth). At the ninth to eleventh periods (T9 to T11), the fifth transistor (T5) is turned off.

During the tenth period (T10), the fourth control signal (GCS4) becomes a low level signal. The second and third control signals (GCS2, GCS3) are high level signals, and the first and fourth control signals (GCS1, GCS4) are low level signals. Therefore, the first, second and sixth transistors (ST1, ST2, ST6) are turned on, and the third and fourth transistors (ST3, ST4) are turned off. The second, fourth, and fifth nodes (N2, N4, N5) are electrically connected to one another, and the first node (N1) and the third node (N3) are electrically connected to each other. The voltage level that was applied to the fifth node (N5) corresponds to the voltage level (Vdata) that was applied to the data line (Dk) before the start of the first period (T1). Since the first node (N1) and the third node (N3) are electrically connected to each other, the driving transistor (DT) may operate like a diode having a threshold voltage (Vth).

In a case where nodes (e.g., N2, N4, and N5) having different voltage levels are electrically connected to one other, by the law of conservation of electric charge, even when the second and sixth transistors (ST2, ST6) are turned on, the electric charge conserved in the first capacitor (C1) and second capacitor (C2) do not change. Since the voltage level being applied to the third voltage supply line (VSL3), the voltage level (V3) being applied to the second voltage supply line (VSL2), and the difference of voltage level (Vth) between the first node (N1) and the second node (N2) do not change, they are offset. Therefore, they may be expressed as shown in mathematical formula 5 below.

$$V_{N2} = \frac{C_1 V_{REF} + C_2 V_{data}}{C_1 + C_2} \quad \text{Formula 5}$$

($C_1$: capacity of the first capacitor (C1), $C_2$: capacity of the second capacitor (C2), Vdata: voltage level of the fifth node (N5) during the third to ninth periods (T3 to T9), VREF: reference level, VN2: the voltage level of the second node (N2) after the second and sixth transistors (ST2, ST6) are turned on).

Herein, since the voltage level of the second node (N2) has been determined, and the driving transistor (DT) operates like a diode having the threshold voltage (Vth), the voltage level of the first node (N1) is as shown in mathematical formula 6 below.

$$V_{N1} = \frac{C_1 V_{REF} + C_2 V_{data}}{C_1 + C_2} - V_{th} \quad \text{Formula 6}$$

(VN1: voltage level of the first node (N1) after the second transistor (ST2) is turned on, Vth: the threshold voltage of the driving transistor (DT)).

Therefore, the voltage stored in the fifth node (N5) during the third to ninth periods (T3 to T9) affects the voltage being applied to the first node (N1). For example, the voltage level (VN1) that is applied to the gate electrode of the driving transistor (DT) after the tenth period (T10) may be expressed as a function of the voltage level (Vdata) at the fifth node (N5) (e.g., corresponding to a charge stored in the second capacitor (C2)) during the third to ninth periods (T3 to T9).

At the start of the eleventh period (T11), the first and fourth control signals (GCS1, GCS4) change to high level signals. Since the sixth transistor (ST6) is turned off, the fifth node (N5) and the fourth node (N4) are electrically disconnected from each other, and therefore the voltage of the first node (N1) does not change. In some embodiments, the first and fourth control signals (GCS1, GCS4) change to high level signals at the same time, but the fourth control signal (GCS4) may instead change to a high level signal after the first control signal (GCS1) changes to a high level signal. Since the first and fourth control signals (GCS1, GCS4) change to high level signals, the first to fourth control signals (GCS1 to GCS4) all become high level signals. The second node and the third node (N2, N3) are floated.

After the first and fourth control signals (GCS1, GCS4) change to high level signals, the second and third control signals (GCS2, GCS3) may change to low level signals. In such a case, when the eleventh period (T11) ends, the first and fourth control signals (GCS1, GCS4) are high level signals, and the second and third control signals (GCS2, GCS3) are low level signals. Therefore, the first, second and sixth transistors (ST1, ST2, ST6) are turned off, and the third and fourth transistors (ST3, ST4) are turned on. The second node (N2) is electrically connected to the second voltage supply line (VSL2) and thus a third level voltage (V3) is applied, and the third node (N3) is electrically connected with the anode electrode (A).

At the start of the second period (T2), a second level voltage (V2) is applied to the first voltage supply line (VSL1), and thus the organic light emitting diode (OLED (j,k)') may emit light. Herein, the level (I) of the current being output to the organic light emitting diode (OLED(j,k)') may be expressed as shown in mathematical formula 7 below.

$$\begin{aligned} I &= k\left\{\left(V_1 - \left(\frac{C_1 V_{REF} + C_2 V_{data}}{C_1 + C_2} - V_{th}\right)\right) - V_{th}\right\}^2 \\ &= k\left(V_1 - \frac{C_1 V_{REF} + C_2 V_{data}}{C_1 + C_2}\right)^2 \end{aligned} \quad \text{Formula 7}$$

(k: proportional constant)

The brightness in which the organic light emitting diode (OLED(j,k)') emits light is proportional to the level (I) of the current, and thus is not affected by the threshold voltage (Vth).

For at least a certain period of time of the second period (T2), a scan signal may be applied to at least some of the scan lines of the scan lines (S1 to Sm). In the embodiment illustrated in FIG. 6, during the second period (T2), the fourth control signal (GCS4) becomes a low level signal, and the scan signal is sequentially applied to all scan lines (S1 to Sm). At the start of the twelfth period (T12), application of the scan signal starts at the first scan line (S1), and at the end of the twelfth period (T12), application of the scan signal ends in the twelfth (or last) scan line (Sm). Since the fourth control signal (GCS4) is a low level signal during the second period (T2), the fourth node (N4) is electrically connected with the fifth node (N5). During a certain period of time during the twelfth period, a scan signal is applied to the scan line (Sj), and the voltage that is applied to the data line (Dk) is stored in the second capacitor (e.g., the voltage at the fifth node (N5)) in the pixel (P(j,k)'). Since the first control signal (GCS1) is a high level signal, and the second transistor (ST2) is turned off, the voltage being applied to the fifth node (N5) does not affect the driving transistor (DT) during the second period (T2).

In a case where the second period (T2) ends, and a first level voltage (V1) is applied to the first voltage supply line (VSL1), the organic light emitting diode (OLED(j,k)') does not emit light as it would in the third period (T3). In the embodiment explained hereinabove, a scan signal is applied to all scan lines (S1 to Sm) but the scan signal may instead be applied to some of the scan lines (S1 to Sm) after the start of the eleventh period (T11) but before the end of the first period (T1).

Figure 7:
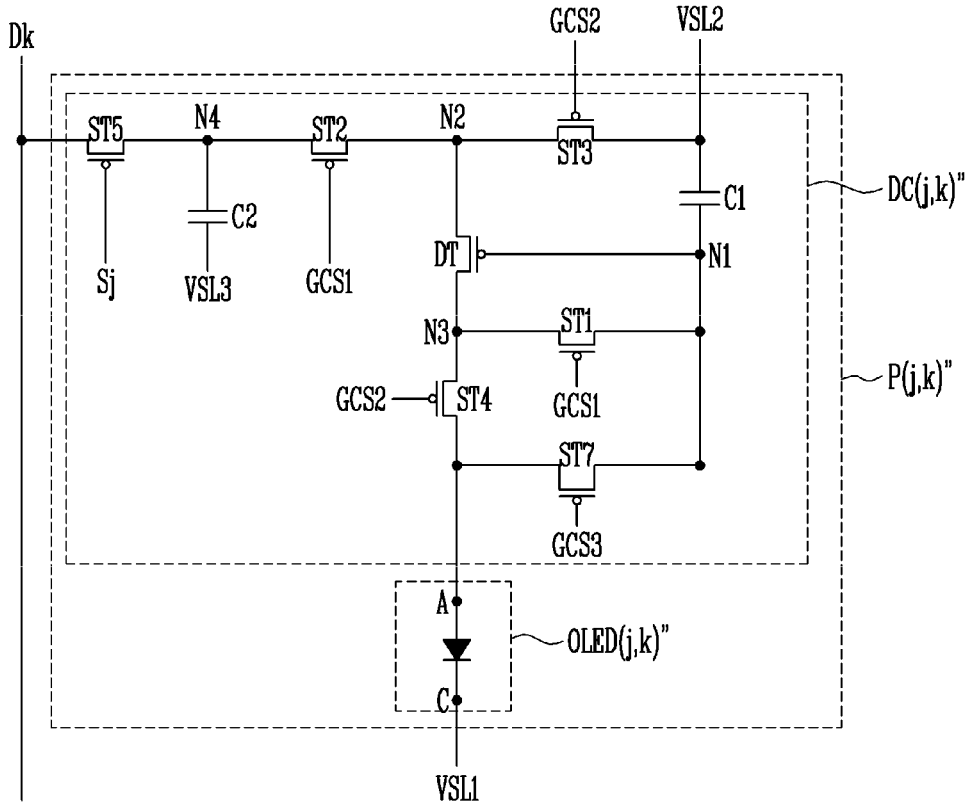
FIG. 7 is a view for explaining another embodiment of the pixel illustrated in FIG. 1.

FIG. 7 illustrates a view for explaining another embodiment of each pixel in the organic light emitting display device illustrated in FIG. 1. FIG. 7 representatively illustrates pixels (P(j,k, j and k being positive integers)") electrically connected to a scan line (Sj) and data line (Dk).

Referring to FIG. 7, the pixel (P(j,k)") includes an organic light emitting diode (OLED(j,k)") and a pixel driving circuit (DC(j,k)"). The pixel (P(j,k)") includes a driving transistor (DT), first, second, third, fourth, fifth, and seventh transistors (ST1, ST2, ST3, ST4, ST5, ST7), and first and second capacitors (C1, C2). The driving transistor (DT), the first transistor (ST1), the fifth transistor (ST5), the first capacitor (C1), and the second capacitor (C2) of the pixel (P(j,k)") are the same as the driving transistor (DT), the first transistor (ST1), the fifth transistor (ST5), the first capacitor (C1), and the second capacitor (C2) explained with reference to FIG. 3, and thus further explanation is omitted.

To the gate electrode of the second transistor (ST2), the first control signal (GCS1) is applied similar to the gate electrode of the first transistor (ST1), the first electrode is connected to the fourth node (N4), and the second electrode is connected to the second node (N2). Herein, the first electrode may be a source electrode or drain electrode, and the second electrode may be a the other one of the source and drain electrodes. For example, when the first electrode is a drain electrode, the second electrode may be a source electrode, or vice versa. Definitions of the first electrode and the second electrode may each be applied to third, fourth, fifth and seventh transistors (ST3, ST4, ST5, ST7), which will be explained hereinafter.

To the gate electrode of the third transistor (ST3), the second control signal (GCS2) is applied, the first electrode is connected to the second voltage supply line (VSL2), and the second electrode is connected to the second node (N2).

To the gate electrode of the fourth transistor (ST4), the second control signal (GCS2) is applied similarly to the gate electrode of the third transistor (ST3), the first electrode is connected to the third node (N3), and the second electrode is connected to the anode electrode (A).

To the gate electrode of the seventh transistor (ST7), the third control signal (GCS3) is applied, the first electrode is connected to the first node (N3), and the second electrode is connected to the anode electrode (A).

The anode electrode (A) of the organic light emitting diode (OLED(j,k)") is connected to the second electrode of the fourth and seventh transistors (ST4, ST7), and the cathode electrode (C) is electrically connected to the first voltage supply line (VSL1).

Figure 8:
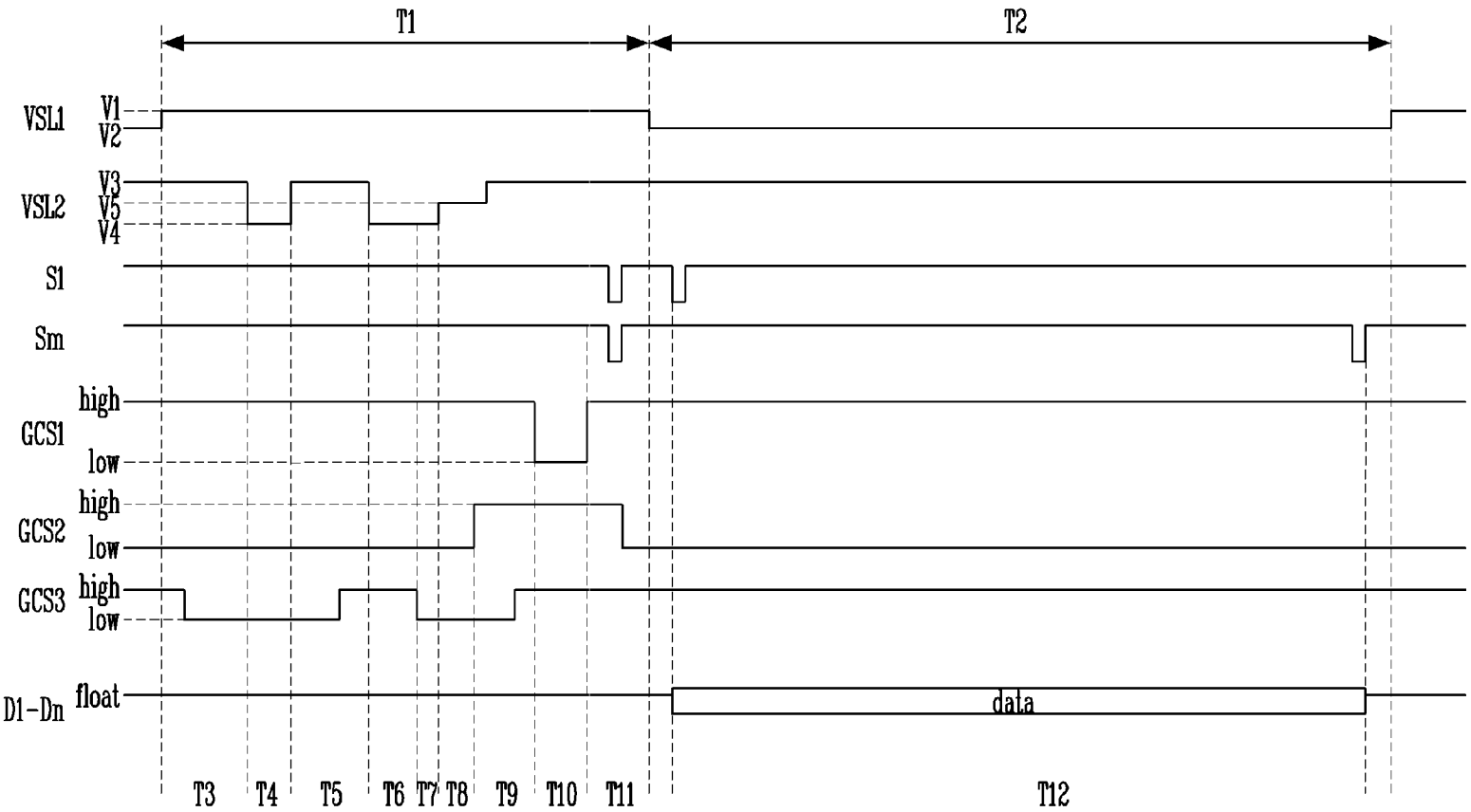
FIG. 8 is a view for explaining a method for driving the pixel illustrated in FIG. 7.

FIG. 8 is a view for explaining a method for driving a pixel illustrated in FIG. 7. Referring to FIGS. 7 and 8, a first level voltage (V1) is applied to the first voltage supply line (VSL1) during the first period (T1), and thus, the organic light emitting diode (OLED(j,k)") in the pixel does not emit light, thereby stopping displaying. The first period (T1) may correspond to the steps of stopping displaying (Off, Off') of FIG. 2. During the second period (T2), the second level voltage (V2) is applied to the first voltage supply line (VSL1), and thus the organic light emitting diode (OLED (j,k)") in the pixel (P(j,k)") may emit light. The second period (T2) may correspond to the steps of displaying an image (L, R) of FIG. 2. The first period (T1) including the third period to the eleventh period (T3 to T11), and the second period (T2) including the twelfth period (T12) are the same as in FIGS. 3 and 4. At the first period (T1), the data lines (D1 to Dn) may be floated.

In FIG. 8, in a case where the first control signal (GCS1) is a high level signal, the first and second transistors (ST1, ST2) where the first control signal (GCS1) is applied to the gate electrode are turned off. In a case where the first control signal (GCS1) is a low level signal, the first and second transistors (ST1, ST2) where the first control signal (GCS1) is applied to the gate electrode are turned on. Likewise, it is possible to control the state of the third, fourth, and seventh transistors (ST3, ST4, ST7) with the second to third control signals (GCS2 to GCS3). At the first and second periods (T1, T2), a certain level of the voltage may be applied to the third voltage supply line (VSL3). However, operations of the transistors (ST1, ST2, ST3, ST4, ST7) and the level of voltage that is applied to the third supply line (VSL3) according to the control signals (GCS1 to GCS4) are merely examples.

At the start of the third period (T3), the level of the voltage being applied to the first voltage supply line (VSL1) changes to the first level (V1), and thus the organic light emitting diode (OLED(j,k)") stops emitting light. The level of the voltage being applied to the second voltage supply line (VSL2) does not change but maintains the third level (V3). The third level (V3) may correspond to or may be substantially the same as the first level (V1). Since the first voltage supply line (VSL1) is connected to all of the pixels (P(1,1) to P(m,n)), all organic light emitting diodes stop emitting light. The first and third control signals (GCS1 and GCS3) are high level signals, and the second control signal (GCS2) is a low level signal. Therefore, the first, second and seventh transistors (ST1, ST2, ST7) are turned off, and the third and fourth transistors (ST3, ST4) are turned on. The second node (N2) is electrically connected with the second voltage supply line (VSL2) and thus a voltage having a third level (V3) is applied, and the third node (N3) is electrically connected with the anode electrode (A).

After the voltage level being applied to the first voltage supply line (VSL1) changes to a third level (V3), the third control signal (GCS3) may change to a low level signal. In this case, when the third period (T3) ends, the first control signal (GCS1) is a high level signal, and the second and third control signals (GCS2, GCS3) are low level signals. Therefore, the first and second transistors (ST1, ST2) are turned off, and the third, fourth, and seventh transistors (ST3, ST4, ST7) are turned on. The second node (N2) is electrically connected with the second voltage supply line (VSL2), and the first and third nodes (N1, N3) are electrically connected with the anode electrode (A).

Since the first node (N1) and the third node (N3) are electrically connected to each other, the driving transistor (DT) may operate like a diode.

At the fourth period (T4), the level of the voltage being applied to the second voltage supply line (VSL2) changes to a fourth level (V2), which is lower than the first level (V1), and thus the driving transistor (DT) comes to an off state. The fourth level (V4) may correspond to or may be substantially the same as the second level (V2). At the fourth period (T4), the first control signal (GCS1) is a high level signal and the second and third control signals (GCS2, GCS3) are low level signals. Therefore, the first and second transistors (ST1, ST2) are turned off, and the third, fourth and seventh transistors (ST3, ST4, ST7) are turned on. The second node (N2) is electrically connected to the second voltage supply line (VSL2) and thus a voltage having a fourth level (V4) is applied. The first and third nodes (N1, N3) are electrically connected with the anode electrode (A).

At the start of the fifth period (T5), the voltage level being applied to the second voltage supply line (VSL2) changes to a third level (V3) again. The first and second transistors (ST1, ST2) are turned off, and the third, fourth and seventh transistors (ST3, ST4, ST7) are turned on. The second node (N2) is electrically connected to the second voltage supply line (VSL2) and thus a voltage having a third level (V3) is applied to the second node (N2). The first and third nodes (N1, N3) are electrically connected with the anode electrode (A).

After the voltage level being applied to the second voltage supply line (VSL2) changes to the third level (V3), the third control signal (GCS3) may change to a high level signal. In this case, when the fifth period (T5) ends, the first and third control signals (GCS1, GCS3) are high level signals, and the second control signal (GCS2) is a low level signal, and thus the first, second and seventh transistors (ST1, ST2, ST7) are turned off, and the third and fourth transistors (ST3, ST4) are turned on. A third level voltage (V3) is applied to the second node (N2), and the third node (N3) is electrically connected with the anode electrode (A).

At the sixth period (T6), the voltage level being applied to the second voltage supply line (VSL2) changes to a fourth level (V4), and thus the voltage level of the anode electrode (A) changes (e.g., is initialized). During the sixth period (T6), the first and third control signals (GCS1, GCS3) are high level signals, and the second control signal (GCS2) is a low level signal, and thus the first, second and seventh transistors (ST1, ST2, ST7) are turned off, and the third and fourth transistors (ST3, ST4) are turned on. A fourth level voltage (V4) is applied to the second node (N2), and the third node (N3) is electrically connected with the anode electrode (A).

At the seventh period (T7), since the third control signal (GCS3) becomes a low level signal, the first control signal (GCS1) is a high level signal, and the second and third control signals (GCS2, GCS3) are low level signals. Therefore, the first and second transistor (ST1, ST2) are turned off, and the third, fourth and seventh transistors (ST3, ST4, ST7) are turned on. The first and third nodes (N1, N3) are electrically connected with the anode electrode (A), and the second node (N2) is electrically connected with the second voltage supply line (VSL2) and thus a fourth level voltage (V4) is applied. At the seventh period (T7), due to the electrical connection with the third node (N3), the voltage level of the first node (N1) changes (e.g., is initialized).

At the eighth period (T8), the voltage level being applied to the second voltage supply line (VSL2) changes to a fifth level (V5). During the eighth period (T8), the first control signal (GCS1) is a high level signal, and the second and third controls signals (GCS2, GCS3) are low level signals. Therefore, the first and second transistors (ST1, ST2) are turned off, and the third, fourth and seventh transistors (ST3, ST4, ST7) are turned on. The first and third nodes (N1, N3) are electrically connected with the anode electrode (A), and the second node (N2) is electrically connected with the second voltage supply line (VSL2), and thus a fifth level voltage (V5) is applied to the second node (N2). Since the first node (N1) and the third node (N3) are electrically connected to each other, the driving transistor (DT) may operate like a diode. In some embodiments, the fourth level (V4) is lower than the minimum level of the voltage that is applied to the data lines (D1 to Dn). For at least a certain period of time during the eighth period (T8), the current from the second voltage supply line (VSL2) reaches the first node (N1) via the second node (N2) and third node (N3). The voltage level being applied to the first node (N1) increases until the driving transistor (DT) reaches an off state. When the difference of voltage level between the first electrode and the gate electrode of the driving transistor (DT) reaches the threshold voltage (Vth), the driving transistor (DT) comes to an off state, and thus the difference of the voltage level between the voltage being applied to the first node (N1) and the fifth level (V5) is the threshold voltage (Vth).

At the start of the ninth period (T9), since the second control signal (GCS2) changes to a high level signal, the third and fourth transistors (ST3, ST4) are turned off, and compensation of the threshold voltage (Vth) ends. The first and second control signals (GCS1, GCS2) are high level signals, and the third control signal (GCS3) is a low level signal. The first to fourth transistors (ST1 to ST4) are turned off, and the seventh transistor (ST7) is turned on, and thus the second and third nodes (N2, N3) are floated, and the first node (N1) is electrically connected to the anode electrode (A).

After the second control signal (GCS2) changes to a high level signal, the voltage level being applied to the second voltage supply line (VSL2) may change to a third level (V3). Furthermore, after the second control signal (GCS2) changes to a high level signal, the third control signal (GCS3) may change to a high level signal as well. In such a case, when the ninth period (T9) ends, the first to third control signals (GCS1 to GCS3) are all high level signals. Therefore, the first, second, third, fourth, and seventh transistors (ST1, ST2, ST3, ST4, ST7) are turned off. Furthermore, a difference in voltage level between the first node (N1) and the second node (N2) does not change. During the third to ninth periods (T3 to T9), the voltage level at the fourth node (N4) (e.g., corresponding to a charge stored in the second capacitor (C2)) is the level of voltage (Vdata) that is applied to the data line (Dk) before the start of the first period (T1).

During the tenth period (T10), the first control signal (GCS1) becomes a low level. The second and third control signals (GCS2, GCS3) are high level signals, and the first control signal (GCS1) is a low level signal. Therefore, the third, fourth, and seventh transistors (ST3, ST4, ST7) are turned off, and the first and second transistors (ST1, ST2) are turned on. The second node (N2) and the fourth node (N4) are electrically connected to each other, and the first node (N1) and the third node (N3) are electrically connected to each other. Since the first node (N1) and the third node (N3) are electrically connected to each other, the driving transistor (DT) may operate like a diode having the threshold voltage (Vth).

In a case where two nodes (N2, N4) having different voltage levels are electrically connected to each other, by the law of conservation of electric charge, even when the second transistor (ST2) is turned on, the electric charge conserved in the first capacitor (C1) and second capacitor (C2) does not change. Since the voltage level being applied to the third voltage supply line (VSL3), the voltage level (V3) being applied to the second voltage supply line (VSL2), and the difference of voltage level (Vth) between the first node (N1) and the second node (N2) do not change, they are offset. Since the operations are the same as the operations explained at the tenth period (T10) with reference to FIG. 4, the voltage levels of the second node (N2) and first node (N1) each corresponds to mathematical formula 2 and mathematical formula 3. Therefore, the voltage at the fourth node (N4) (e.g., corresponding to a charge stored in the second capacitor (C2)) during the third to ninth periods (T3 to T9) affects the voltage being applied to the first node (N1). That is, the voltage level (VN1) being applied to the first node (N1) after the tenth period (T10) may be expressed as a function of the voltage level (Vdata) stored in the fourth node (N4) during the third to ninth periods (T3 to T9).

At the start of the eleventh period (T11), the first control signal (GCS1) changes to a high level signal, and the first and second transistors (ST1, ST2) are turned off, and thus the second node (N2) is electrically disconnected from the fourth node (N4), and the first node (N1) is electrically disconnected from the third node (N3).

After the first control signal (GCS1) changes to a high level signal, the second control signal (GCS2) may change to a low level signal. In such a case, since the first and third control signals (GCS1, GCS3) are high level signals, and the second control signal (GCS2) is a low level signal, the first, second and seventh transistors (ST1, ST2, ST7) are turned off and the third and fourth transistors (ST3, ST4) are turned on. When the eleventh period (T11) ends, the second node (N2) is electrically connected to the second voltage supply line (VSL2) and thus a third level voltage is applied, and the third node (N3) is electrically connected with the anode electrode (A). During a certain period of time of the eleventh period (T11), a scan signal may be applied to all scan lines (S1 to Sm). When the scan signal is applied, the fifth transistor (ST5) may turn on, and the electric charge that had been stored in the second capacitor (C2) may exit through the data line (Dk). This is a selective process, and thus a scan signal may not be applied to the scan lines (S1 to Sm) during the eleventh period (T11).

At the start of the second period (T2), a second level voltage (V2) is applied to the first voltage supply line (VSL1), and thus the organic light emitting diode (OLED (j,k)") emits light. Herein, the level (I) of the current being output to the (OLED(j,k)") is represented as shown in mathematical formula 4. The brightness in which the organic light emitting diode (OLED(j,k)") emits light is proportionate to the level (I) of the current, and thus is not affected by the threshold voltage (Vth). For at least a certain period of time of the second period (T2), a scan signal may be applied to at least some of the scan lines of the scan lines (S1 to Sm). At the start of the twelfth period (T12), application of the scan signal starts in the scan line (S1), and at the end of the twelfth period (T12), application of the scan signal ends in the scan line (Sm). During a certain period of time of the twelfth period, the scan signal is applied to the scan line (Sj), and the voltage being applied to the data line (Dk) is stored in the second capacitor (C2) (e.g., the voltage at the fourth node (N4)) in the pixel (P(j,k)"). Since the second transistor (ST2) is turned off, the voltage at the fourth node (N4) (e.g., corresponding to a charge stored in the second capacitor (C2)) does not affect the driving transistor (DT) during the second period (T2). In a case where the second period (T2) ends, and a first level voltage (V1) is applied to the first voltage supply line (VSL1), the organic light emitting diode (OLED(j,k)") does not emit light in the third period (T3). Furthermore, in the embodiment explained hereinabove, a scan signal is applied to all scan lines (S1 to Sm) during the second period (T2), but the scan signal may be applied to some of the scan lines (S1 to Sm) even after the start of the eleventh period (T11) but before the start of the first period (T1).

Figure 9:
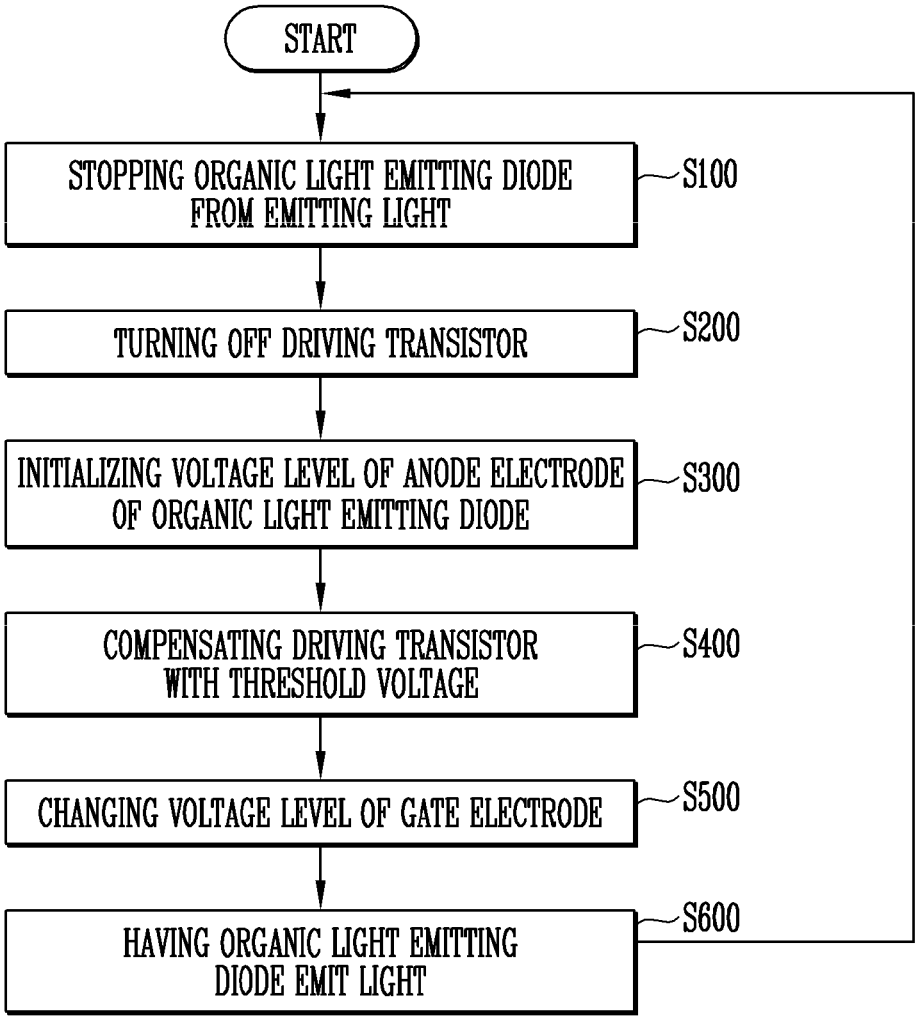
FIG. 9 is a flow diagram for explaining a method for driving an organic light emitting display device according to an embodiment of the present disclosure.

FIG. 9 is a flow diagram for explaining a method for driving an organic light emitting display device according to another embodiment of the present disclosure. Hereinafter, the method for driving an organic light emitting display device according to another embodiment of the present disclosure will be explained with reference to FIGS. 1 to 8.

At step S100, a voltage having a first level is applied to a cathode electrode (C) of an organic light emitting diode, and thus the voltage level of the cathode electrode (C) may be higher than the voltage level of an anode electrode (A). Therefore, pixels (P(1,1) to P(m,n)) do not emit light. This may correspond to a third period (T3) of FIG. 4, FIG. 6 or FIG. 8. A first node (N1) and third node (N3) are electrically connected to each other, and a second node (N2) is electrically connected to a second voltage supply line (VSL2), and a third node (N3) is electrically connected to the anode electrode (A), and a third level voltage (V3) is applied to the second voltage supply line (VSL2). The third level (V3) may correspond to or may substantially be the same as the first level (V1).

At step S200, the first node (N1) and third node (N3) are electrically connected to the anode electrode (A), and the second node (N2) is electrically connected to the second voltage supply line (VSL2), and thus the driving transistor (DT) is turned off. This may correspond to the fourth period (T4) of FIG. 4, FIG. 6 or FIG. 8. The first node (N1) and the third node (N3) are electrically connected, and the second node (N2) is electrically connected to the second voltage supply line (VSL2), and the third node (N3) is electrically connected to the anode electrode (A), and a fourth level voltage (V4) is applied to the second voltage supply line (VSL2). The fourth level (V4) may correspond to or may be substantially the same as the second level (V2).

At step S300, the voltage level being applied to the second voltage supply line (VSL2) changes to a fourth level (V4), and thus the voltage level of the anode electrode (V) changes (e.g., initialized). This may correspond to the sixth period (T6) of FIG. 4, FIG. 6, or FIG. 8. The first node (N1) and the third node (N3) are electrically disconnected from each other, the second node (N2) is electrically connected to the second voltage supply line (VSL2), the third node (N3) is electrically connected to the anode electrode (A), and a fourth level voltage (V4) is applied to the second voltage supply line (VSL2).

At step S400, a threshold voltage (Vth) may be compensated according to the following two methods. According to an embodiment with reference to FIG. 4 and FIG. 8, the voltage level being applied to the second voltage supply line (VSL2) changes to a fifth level (V5). This may correspond to the eighth period (T8) of FIG. 4 or FIG. 8. In some embodiments, the fifth level (V5) is between the third level (V3) and fourth level (V4), and lower than the minimum level of the voltage being applied to data lines (D1 to Dn). In the case of the pixel driving circuit (DC(j,k) or DC(j,k)"), the first and third nodes (N1, N3) are electrically connected to the anode electrode (A), and the second node (N2) is electrically connected to the second voltage supply line (VSL2). According to an embodiment with reference to FIG. 6, a scan signal is applied to all scan lines (S1 to Sm), and a voltage having a reference level (Vref) is applied to all data lines (D1 to Dn). This may correspond to the eighth period (T8) of FIG. 6. In the case of the pixel driving circuit (DC(j,k)'), the first and third nodes (N1, N3) are electrically connected to the anode electrode (A), and the second node (N2) is electrically connected to the data line (Dk).

At step S500, the voltage that had been applied to the other end of the second capacitor (C2) affects the voltage of the first node (N1). That is, the voltage level of the gate electrode of the driving transistor (DT) changes. This may correspond to the tenth period (T10) of FIG. 4, FIG. 6 or FIG. 8. Herein, the voltage level that is applied to the other end of the second capacitor (C2) corresponds to the level of voltage (Vdata) that is applied to the data line (Dk) before the start of the first period (T1). The one end of the second capacitor (C2) is electrically connected to the third voltage supply line (VSL3), the first node (N1) is electrically connected to the third node (N3), the second node (N2) is electrically connected to the other end of the second capacitor (C2), and the third node (N3) is electrically disconnected from the anode electrode (A).

At step S600, since a second level voltage (V2) is applied to the cathode electrode (C) of the organic light emitting diode, the organic light emitting diode may emit light. This may correspond to the second period (T2) of FIG. 4, FIG. 6 or FIG. 8. A third level voltage (V3) is applied to the second voltage supply line (VSL2) during the second period (T2), and for at least a certain period of time during the second period (T2), a voltage applied to each data line (D1 to Dn) is stored in at least some of the pixels.

By way of summation and review, in order to use shutter glasses together with an organic light emitting display device, the device may be driven four times faster than the frequency of a general display device. For example, in a case where a general display device is driven at 60 Hz, in order to operate together with shutter glasses, the display device should be driven at 240 Hz. Furthermore, since the step of stopping displaying of a 3-dimensional (3D) display device accounts for half of each frame, light may be emitted at twice the luminance to display an image. In the case of such a driving method, since the display device is driven at a high frequency, power consumption increases. Furthermore, an organic light emitting diode being driven according to a conventional 3D method may emit light having a brightness that is twice the brightness of an organic light emitting diode that is driven according to a general method (e.g., 2D method) where the organic light emitting diodes emit light for an entire frame period. This has a problem of reducing the life span of the organic light emitting diode.

An organic light emitting display device and a method for driving thereof according to an embodiment of the present disclosure may include repeating the step of stopping displaying (Off), the step of stopping displaying (Off'), and the step of displaying a right eye image (R) and the step of displaying a left eye image (L), and may reduce the period of the steps of stopping displaying (Off, Off'), and may reduce the brightness at the steps of displaying an image (L, R), thereby increasing the life span of the organic light emitting display device.

Example embodiments have been disclosed herein, and although specific terms are employed, they are used and are to be interpreted in a generic and descriptive sense only and not for purpose of limitation. In some instances, as would be apparent to one of ordinary skill in the art at the time of filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. An organic light emitting display device comprising:

pixels, each comprising an organic light emitting diode having an anode electrode and a cathode electrode, and a pixel driving circuit configured to output a driving current to the organic light emitting diode;

scan lines and data lines electrically connected to the pixels; and a first voltage supply line and a second voltage supply line electrically connected to the pixels, wherein the pixel driving circuit comprises a driving transistor configured to control a level of each driving current, the cathode electrode is electrically connected to the first voltage supply line, the organic light emitting diode is configured to not emit light during a first period where a first level voltage is applied to the first voltage supply line, and is configured to emit light during a second period where a second level voltage is applied to the first voltage supply line, a voltage stored in the pixels, during at least a portion of the first period, affects a voltage applied to a gate electrode of the driving transistor, a third level voltage is applied to the second voltage supply line during the second period, and is stored in at least some of the pixels during at least a portion of the second period, the organic light emitting display device further comprises a third voltage supply line electrically connected to the pixels, the pixel driving circuit further comprises a first transistor, a second transistor, a third transistor, a fourth transistor, a fifth transistor, a first capacitor, and a second capacitor, the gate electrode of the driving transistor is directly connected to a first node, a first electrode of the driving transistor is connected to a second node, and a second electrode of the driving transistor is connected to a third node, a first electrode of the first transistor is connected to the first node, and a second electrode of the first transistor is connected to the third node, a first electrode of the second transistor is connected to a fourth node, and a second electrode of the second transistor is directly connected to the second node, a first electrode of the third transistor is connected to the second voltage supply line, and a second electrode of the third transistor is directly connected to the second node, a first electrode of the fourth transistor is connected to the third node, and the second electrode of the fourth transistor is connected to the anode electrode, a gate electrode of the fifth transistor is connected to one of the scan lines, a first electrode of the fifth transistor is connected to one of the data lines, and a second electrode of the fifth transistor is connected to the fourth node, one end of the first capacitor is directly connected to the second voltage supply line, and another end of the first capacitor is directly connected to the first node, and one end of the second capacitor is connected to the third voltage supply line, and another end of the second capacitor is connected to the fourth node.

2. The organic light emitting display device according to claim 1, wherein a first control signal is applied to a gate electrode of the first transistor, a second control signal is applied to a gate electrode of the second transistor, a third control signal is applied to a gate electrode of the third transistor, and a fourth control signal is applied to a gate electrode of the fourth transistor.

3. The organic light emitting display device according to claim 1, wherein the organic light emitting display device further comprises a sixth transistor connected between the fourth node and the second capacitor, and wherein a first control signal is applied to a gate electrode of the first transistor and a gate electrode of the second transistor, a second control signal is applied to a gate electrode of the third transistor, a third control signal is applied to a gate electrode of the fourth transistor, and a fourth control signal is applied to a gate electrode of the sixth transistor.

4. The organic light emitting display device according to claim 1, wherein the organic light emitting display device further comprises a seventh transistor connected between the first node and the anode electrode, a first control signal is applied to a gate electrode of the first transistor and a gate electrode of the second transistor, a second control signal is applied to a gate electrode of the third transistor and a gate electrode of the fourth transistor, and a third control signal is applied to a gate electrode of the seventh transistor.

5. The organic light emitting display device according to claim 2, wherein during the first period, the driving transistor is turned off in response to a fourth level voltage being applied to the second voltage supply line, the first transistor, the third transistor, and the fourth transistor being turned on, and the second transistor being turned off, and during the first period, a voltage level of the anode electrode is initialized in response to the fourth level voltage being applied to the second voltage supply line, the third transistor and the fourth transistor being turned on, and the first transistor and the second transistor being turned off.

6. The organic light emitting display device according to claim 4, wherein during the first period, the driving transistor is turned off in response to a fourth level voltage being applied to the second voltage supply line, the third transistor, the fourth transistor, and the seventh transistor being turned on, and the first transistor and the second transistor being turned off, and during the first period, a voltage level of the anode electrode is initialized in response to the fourth level voltage being applied to the second voltage supply line, the third transistor and the fourth transistor being turned on, and the first transistor, the second transistor, and the seventh transistor being turned off.

7. The organic light emitting display device according to claim 2, wherein during the first period, a threshold voltage of the driving transistor is compensated in response to a fifth level voltage being applied to the second voltage supply line, the first transistor, the third transistor, and the fourth transistor being turned on, and the second transistor being turned off.

8. The organic light emitting display device according to claim 3, wherein during the first period, a threshold voltage of the driving transistor is compensated in response to a reference level voltage being applied to the data lines, the first transistor, the second transistor, the fourth transistor and the fifth transistor being turned on, and the third transistor and the sixth transistor being turned off.

9. The organic light emitting display device according to claim 4, wherein during the first period, a threshold voltage of the driving transistor is compensated in response to a fifth level voltage being applied to the second voltage supply line, the third transistor, the fourth transistor, and the seventh transistor being turned on, and the first transistor and second transistor being turned off.

10. The organic light emitting display device according to claim 2, wherein the voltage stored in the pixels comprises the voltage being stored in the fourth node, and in response to the second transistor being turned on, the voltage stored in the fourth node affects a voltage being applied to the first node.

11. The organic light emitting display device according to claim 3, wherein:

the voltage stored in the pixels comprises the voltage being stored in a fifth node, and in response to the second transistor and the sixth transistor being turned on, the voltage stored in the fifth node affects a voltage being applied to the first node.

12. The organic light emitting display device according to claim 5, wherein:

the third level voltage corresponds to the first level voltage, and the fourth level voltage corresponds to the second level voltage.

13. The organic light emitting display device according to claim 7, wherein the fifth level voltage is between the third level voltage and a fourth level voltage, and is lower than a minimum level of the voltage applied to the data lines.

14. A method for driving an organic light emitting display device comprising pixels, each comprising an organic light emitting diode having an anode electrode and a cathode electrode, and a pixel driving circuit configured to output a driving current to the organic light emitting diode; scan lines and data lines electrically connected to the pixels; a first voltage supply line connected to the cathode electrode and a second voltage supply line electrically connected to a gate electrode of a driving transistor through a first capacitor, the method comprising:

stopping the organic light emitting diode from emitting light;

turning off the driving transistor in the pixel driving circuit;

initializing a voltage level of the anode electrode;

compensating a threshold voltage of the driving transistor; and emitting light with the organic light emitting diode, wherein at the stopping the organic light emitting diode from emitting light, a voltage level applied to the first voltage supply line changes to a first level, at the emitting light with the organic light emitting diode, a voltage level being applied to the first voltage supply line changes to a second level, a voltage having a third level is applied to the second voltage supply line, and a voltage is stored in at least some of the pixels, at the turning off the driving transistor in the pixel driving circuit, the gate electrode of the driving transistor is electrically connected to a second electrode of the driving transistor, a first electrode of the driving transistor is electrically connected to the second voltage supply line, the second electrode of the driving transistor is electrically connected to the anode electrode, and a third level voltage is applied to the second voltage supply line, and at the initializing a voltage level of the anode electrode, the gate electrode of the driving transistor is electrically disconnected from the second electrode of the driving transistor, the first electrode of the driving transistor is electrically connected to the second voltage supply line, the second electrode of the driving transistor is electrically connected to the anode electrode, and a fourth level voltage is applied to the second voltage supply line.

15. The method according to claim 14, wherein at the compensating a threshold voltage of the driving transistor, the gate electrode of the driving transistor is electrically connected to the second electrode of the driving transistor, the first electrode of the driving transistor is electrically connected to the second voltage supply line, the second electrode of the driving transistor is electrically connected to the anode electrode, and a fifth level voltage is applied to the second voltage supply line.

16. The method according to claim 15, wherein the fifth level voltage is between the third level voltage and the fourth level voltage, and is lower than a minimum level that at which a voltage is to be applied to the data lines.

17. The method according to claim 14, wherein at the compensating a threshold voltage of the driving transistor, the gate electrode of the driving transistor is electrically connected to the second electrode of the driving transistor, the first electrode of the driving transistor is electrically connected to one of the data lines, the second electrode of the driving transistor is electrically connected to the anode electrode, and a reference level voltage is applied to the data lines.

18. A method for driving an organic light emitting display device comprising pixels, each comprising an organic light emitting diode having an anode electrode and a cathode electrode, and a pixel driving circuit configured to output a driving current to the organic light emitting diode; scan lines and data lines electrically connected to the pixels; a first voltage supply line connected to the cathode electrode and a second voltage supply line electrically connected to a gate electrode of a driving transistor through a first capacitor, the method comprising:

stopping the organic light emitting diode from emitting light;

turning off the driving transistor in the pixel driving circuit;

initializing a voltage level of the anode electrode;

compensating a threshold voltage of the driving transistor;

emitting light with the organic light emitting diode; and changing a voltage level of the gate electrode of the driving transistor after the compensating of the threshold voltage of the driving transistor;

wherein at the stopping the organic light emitting diode from emitting light, a voltage level applied to the first voltage supply line changes to a first level, at the emitting light with the organic light emitting diode, a voltage level being applied to the first voltage supply line changes to a second level, a voltage having a third level is applied to the second voltage supply line, and a voltage is stored in at least some of the pixels, the organic light emitting display device further comprises a third voltage supply line, the pixel driving circuit further comprises a second capacitor, at the changing a voltage level of the gate electrode of the driving transistor, one end of the second capacitor is electrically connected to the third voltage supply line, the gate electrode of the driving transistor is electrically connected to a second electrode of the driving transistor, a first electrode of the driving transistor is electrically connected to another end of the second capacitor, and the second electrode of the driving transistor is electrically disconnected from the anode electrode, and a voltage stored in the pixels affects a voltage applied to the gate electrode of the driving transistor.

* * * * *